US006354589B1

(12) United States Patent
Taruki et al.

(10) Patent No.: US 6,354,589 B1
(45) **Date of Patent: *Mar. 12, 2002**

(54) SHEET FEED APPARATUS, METHOD AND COMPUTER READABLE MEDIUM FOR DOUBLE-SIDED DOCUMENT SHEET FEED OPERATIONS

(75) Inventors: Takashi Taruki, Hiratsuka; Shinji Imoto, Kawasaki, both of (JP)

(73) Assignee: Ricoh Company, Ltd., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/393,678

(22) Filed: Sep. 10, 1999

(30) Foreign Application Priority Data

Sep. 11, 1998 (JP) ..... 10-258922
Sep. 10, 1999 (JP) ..... 11-257762

(51) Int. Cl.[7] ..... B65H 7/02
(52) U.S. Cl. ..... 271/265.01; 265/225
(58) Field of Search ..... 271/225, 265.01

(56) References Cited

U.S. PATENT DOCUMENTS 4,579,326 A * 4/1986 Pinckney et al. ..... 271/3.03
4,621,801 A * 11/1986 Sanchez ..... 271/251
4,884,097 A * 11/1989 Giannetti et al. ..... 355/23
4,884,794 A * 12/1989 Dinatale et al. ..... 271/3.19
5,132,742 A * 7/1992 Goto ..... 399/401
5,203,554 A * 4/1993 Suzuki et al. ..... 271/10.05
5,430,536 A * 7/1995 Fullerton et al. ..... 399/364
5,552,859 A * 9/1996 Nakagawa et al. ..... 399/23
5,596,399 A * 1/1997 Dempsey et al. ..... 399/45
5,671,917 A * 9/1997 Choho et al. ..... 271/111
5,754,934 A * 5/1998 Kamezaki et al. ..... 399/373
5,784,680 A * 7/1998 Taruki ..... 399/374
5,839,044 A * 11/1998 Taruki ..... 399/361
5,995,801 A * 11/1999 Katsuta et al. ..... 399/367
6,081,688 A * 6/2000 Okada et al. ..... 399/374

FOREIGN PATENT DOCUMENTS

| | | |
|---|---|---|
| JP | 6-118737 | 4/1994 |
| JP | 7-109060 | 4/1995 |
| JP | 9-106116 | 4/1997 |
| JP | 10-87187 | 4/1998 |

OTHER PUBLICATIONS

Partial English Translation of Japanese Patent Document 6–118737 (published Apr. 28, 1994) filed in IDS with English Abstract on Nov. 23, 1999.

* cited by examiner

*Primary Examiner*—Christopher P. Ellis
*Assistant Examiner*—Kenneth W Bowers
(74) *Attorney, Agent, or Firm*—Oblon, Spivak, McClelland, Maier & Neustadt, P.C.

(57) ABSTRACT

An automatic sheet feeding apparatus method and computer readable medium capable of performing an efficient reading operation includes a sheet table, a sheet transfer mechanism, and a controller. The sheet transfer mechanism performs first, second, and third transfer operations. In the first transfer operation, a sheet is separated from the sheet table and is transferred via a first connecting path to the reading position to receive a front-face sheet feeding operation. In the second transfer operation, the sheet is transferred via the first connecting path to the reading position to receive a rear-face sheet feeding operation. In the third transfer operation, the sheet is ejected. The sheet is reversed after passing by the reading position in each of the first and second transfer operations. The controller controls the sheet transfer mechanism to perform the first transfer operation relative to a succeeding sheet at one of a time before the third transfer operation is performed relative to a preceding sheet when the sheet has a shorter length than a predetermined value in a direction parallel to a transfer direction and a time after a preceding sheet passes by the reading position during the third transfer operation relative to the preceding sheet when the sheet has a longer length than a predetermined value in a direction parallel to the transfer direction.

34 Claims, 18 Drawing Sheets

SHEET FEED APPARATUS, METHOD AND COMPUTER READABLE MEDIUM FOR DOUBLE-SIDED DOCUMENT SHEET FEED OPERATIONS

BACKGROUND OF THE INVENTION

1. Field of the Invention

This invention relates to a sheet feed apparatus, method and computer readable medium and more particularly to a sheet feed apparatus, method and computer readable medium which is capable of performing sheet feed operations in an efficient manner to meet the requirements for quickly reading document sheets which are, in particular, printed on both sides (e.g., also referred to as "double-sided printed").

2. Discussion of Background

Automatic sheet feed apparatuses are convenient, in particular, when you deal with a large number of sheets and therefore they are widely used for copying machines, facsimile machines, and so on. In one type of such automatic sheet feed apparatus, a sheet is transferred line by line relative to a fixed reading position and is automatically turned when both sides of the sheet are needed to be read. While turning one sheet, an automatic sheet feed apparatus can insert a succeeding sheet. That is, a closed sheet path built in such a sheet feed apparatus brings possibilities of multi-sheet handling so as to improve the sheet feed efficiency.

In recent years, there have been various techniques introduced for handling double-sided printed documents. One example is Japanese Laid-Open Patent Publication No. JPAP07-109060 (1995) which describes an automatic sheet feed apparatus having two paths each for ejecting a sheet after a reading operation and another two paths each for reversing a sheet so as to allow a double-sided reading operation in a relatively fast manner and also to collate a page order. However, this technique results in a complex apparatus with increased manufacturing costs.

SUMMARY OF THE INVENTION

Accordingly, an object of the present invention is to provide a novel automatic sheet feeding apparatus, method and computer readable medium which is capable of efficiently performing a sheet feeding operation for the requirements of double-sided reading operations.

To achieve the above and other objects, the present invention provides a novel automatic sheet feeding apparatus, method and computer readable medium which includes a sheet table, a sheet transfer mechanism, and a controller. The sheet table holds a sheet set including at least one sheet. The sheet transfer mechanism performs first, second, and third transfer operations, in a sequential manner. In the first transfer operation, a sheet is separated one by one from the sheet set placed on the sheet table and is transferred via a first connecting path to the reading position to receive a front-face sheet feeding operation. In the second transfer operation, the sheet is transferred via the first connecting path to the reading position to receive a rear-face sheet feeding operation. In the third transfer operation, the sheet is ejected. The sheet is reversed relative to a top and bottom orientation after passing by the reading position in each of the first and second transfer operations. The controller controls the sheet transfer mechanism to perform the first transfer operation relative to a succeeding sheet at one of a time before the third transfer operation is performed relative to a preceding sheet when the sheet has a shorter length than a predetermined value in a direction parallel to a transfer direction and a time after a preceding sheet passes by the reading position during the third transfer operation relative to the preceding sheet when the sheet has a longer length than a predetermined value in a direction parallel to the transfer direction.

The sheet transfer mechanism may include a first path member, a switchback member, and a second path member. The first path member provides a switchback path. The first path member is positioned under the sheet table and is connected to the reading position via a second connecting path to receive the sheet after one of the front-face and rear-face sheet feeding operations. The second connecting path includes a sheet eject portion for ejecting the sheet under control of the controller. The switchback member is mounted on the first path member. The switchback member forwards, holds, and reverses the sheet under control of the controller. The second path member is positioned under the sheet table and provides a reverse path through which the sheet passes and in which the sheet is held under control of the controller. The second path member is connected to the first path member at one end thereof to receive the sheet moved in a reversed direction from the first path member. The second path member is also connected to the first connecting path at the other end thereof to transfer the sheet to the reading position.

The sheet transfer mechanism may further includes a switchback member moving mechanism, mounted on the first path member, for moving the switchback member to free the sheet in the first path member. The controller controls the sheet transfer mechanism to perform the first transfer operation relative to a succeeding sheet before the third transfer operation is performed relative to a preceding sheet when the sheet has a longer length than a predetermined value in a direction parallel to the transfer direction. Further, the controller controls the switchback member moving mechanism to move the switchback member to free the preceding sheet during the third transfer operation so that the succeeding sheet of the first transfer operation is allowed to enter into the first path member in contact with the preceding sheet and then controls the switchback member moving mechanism to return the switchback member so as to reverse the preceding sheet and to send forward the succeeding sheet simultaneously.

The sheet feed apparatus may further includes a sheet eject tray, mounted under the first path member, for receiving the sheet ejected from the sheet eject portion of the second connecting path included in the transfer mechanism. The switchback member may include a drive roller rotatable in forward and reverse directions and a driven roller. The switchback member may include a drive roller rotatable in forward and reverse directions and a driven roller movable by the switchback member moving mechanism. The drive roller may be mounted under the driven roller on the first path member. The sheet transfer mechanism may further include a first detecting mechanism, mounted before the sheet eject portion on the second connecting path, for detecting a trailing edge of the sheet. The controller controls the sheet transfer mechanism to perform the first transfer operation relative to a succeeding sheet when the first detecting mechanism detects the trailing edge of a preceding sheet during one of the second transfer operation when the preceding sheet has a shorter length than the predetermined value in a direction parallel to the transfer direction and the third transfer operation when the preceding sheet has a longer length than the predetermined value in a direction parallel to the transfer direction. The sheet transfer mechanism may further include a sheet flow switch mechanism, mounted at a position downstream of the second connecting path, for switching under control of the controller between a first sheet flow in which the sheet is transferred through the second connecting path to the sheet eject tray, a second sheet flow in which the sheet is transferred through the second connecting path to the first path member, and a third sheet flow in which the sheet is transferred from the first path member to the second path member. The sheet transfer mechanism may further include a sheet feed mechanism, mounted upstream of the first connecting path, for separating the sheet from the sheet set placed on the sheet table and transfers to the reading position during the first sheet transfer operation and a third detecting mechanism, mounted downstream from the sheet feed mechanism and upstream from a point at which the second path member is connected to the as first connecting path, for detecting a sheet separated from the sheet set. The controller controls the sheet feed mechanism to perform the first sheet transfer operation after the preceding sheet passes by the reading position and to stop the first sheet transfer operation when detecting mechanism detects the succeeding sheet.

Other objects, features, and advantages of the present invention will become apparent from the following detailed description when read in conjunction with the accompanying drawings.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
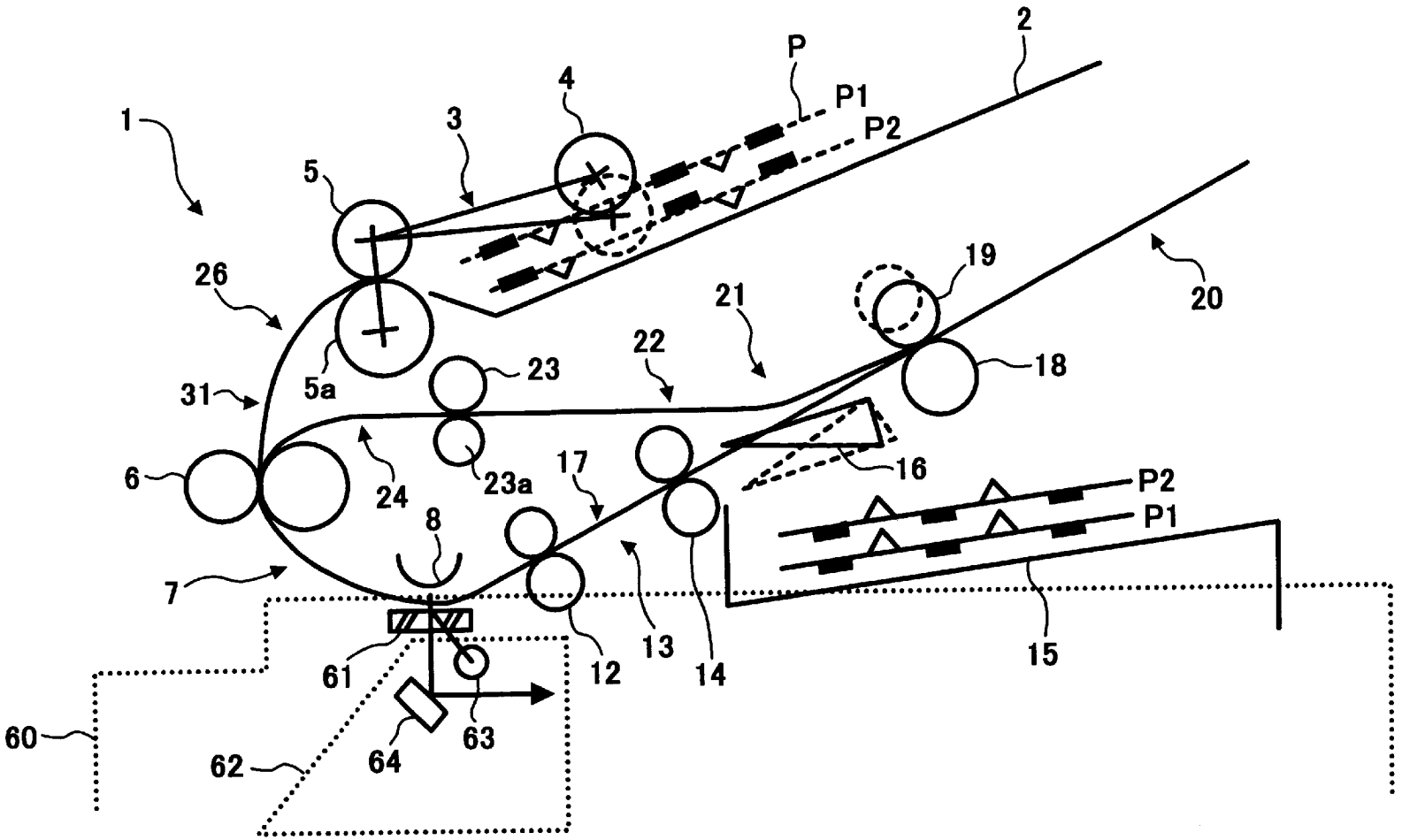
FIG. 1 is a schematic diagram for explaining an exemplary structure of an automatic sheet feed apparatus according to an embodiment of the present invention.

In describing preferred embodiments of the present invention illustrated in the drawings, specific terminology is employed for the sake of clarity. However, the present invention is not intended to be limited to the specific terminology so selected and it is to be understood that each specific element includes all technical equivalents which operate in a similar manner.

Referring now to the drawings, wherein like reference numerals designate identical or corresponding parts throughout the several views, and more particularly to FIG. 1 thereof, there is illustrated an exemplary structure of an automatic document feeding apparatus (ADF) 1 according to an embodiment of the present invention, and an upper part of a copying apparatus 60. The ADF 1 can be installed on and operable with various types of image forming apparatuses such as, for example, a copying machine (i.e., the copying apparatus 60), a facsimile machine, and so forth.

The copying apparatus 60 of FIG. 1 is a general copying machine and includes on the top surface thereof a slit glass 61 and a contact glass (not shown). The copying apparatus 60 further includes an image reading mechanism 62 which includes an exposure lamp 63, a first mirror 64, a charge-coupled device (CCD, not shown), and so forth under the slit glass 61 and the contact glass. The exposure lamp 63 emits light to which an original sheet is exposed through the slit glass 61 or the contact glass. The light reflected from the original sheet falls on the first mirror 64 and is reflected thereby. The light passes through a lens (not shown) which focuses the light on the CCD and forms an image thereon.

The image reading mechanism 62 performs a book reading operation in which the image reading mechanism 62 movably reads an original sheet placed on the glass and a sheet reading operation in which the image reading mechanism 62 stationarily reads an original sheet movably placed on the slit glass 61. In the book reading operation, the exposure lamp 63 and the first mirror 64 together move in the direction A to read an original sheet placed on the contact glass, while in a sheet reading operation the exposure lamp 63 and the first mirror 64 stay at a position under the slit glass 61 to read an original sheet placed at a reading position on the slit glass 61.

In the ADF 1 installed on the copying apparatus 60, a white guide plate 8 is provided on the bottom thereof above the slit glass 61 of the copying apparatus 60. The white guide plate 8 is used as a reference white image and provides a reference white image reading value when it is read by the image reading mechanism 62. On an upper part of the ADF 1, a sheet table 2 is provided for placing thereon an original sheet set P including original sheets P1 to Pn, wherein n is positive integer. In this case, the original sheet set P includes the original sheet P1 at an uppermost position, next an original sheet P2, and so on, each of which is printed on both sides thereof. On the sheet table 2, each sheet is placed with a front face up and a rear face down, which is referred to as a front-face-up orientation. When each sheet is reversed with the front face down and the rear face up, it is referred to as a rear-face-up orientation. In order to indicate whether the sheet is in the front-face-up or rear-face-up orientation, in the figures, a front face is indicated with bar marks and a rear face is indicated with triangle marks.

The ADF 1 includes a separation and transfer mechanism which includes a pick-up roller 4, a separation roller set 5, a pair of pull-out rollers 6, and a pair of transfer rollers 12. In the separation and transfer mechanism, the pick-up roller 4 rotates clockwise and makes contact with the original sheet set P so as to feed it to the separation roller set 5. At this time, it is possible that some original sheets are moving together with the original sheet P1 by the action of static electricity. The separation roller set 5 includes two rollers, both rotating clockwise normally and which transfer the uppermost original sheet P1 forward and the other sheets backward, thereby separating the original sheet P1 from the original sheet set P. The original sheet P1 is so forwarded to the slit glass 61 by the pull-out rollers 6 and the transfer rollers 12 which are arranged along a first sheet path 31 formed inside the ADF 1. By this time, the original sheet P1 is turned in the rear-face-up orientation and therefore the front face thereof is then ready to be read.

In this example, the pick-up roller 4, the separation roller set 5, the pull-out rollers 6, and the transfer rollers 12 are driven by a sheet feed motor 51 (FIG. 2), e.g., a stepping motor or the like. A lower side roller of the separation roller set 5, which is referred to as a lower separation roller 5*a*, is connected to a sheet feed clutch 55 (FIG. 2) for turning on and off the separation roller set 5. More specifically, a controller 50 (FIG. 2), e.g., including an internal/external memory device for storing computer program instructions, generates a signal which controls the sheet feed clutch 55 (FIG. 2) such that transmission of the driving force from the sheet feed motor 51 (FIG. 2) to the lower separation roller 5*a* is stopped when the original sheet P1 is separated from the original sheet set P.

Figure 2:
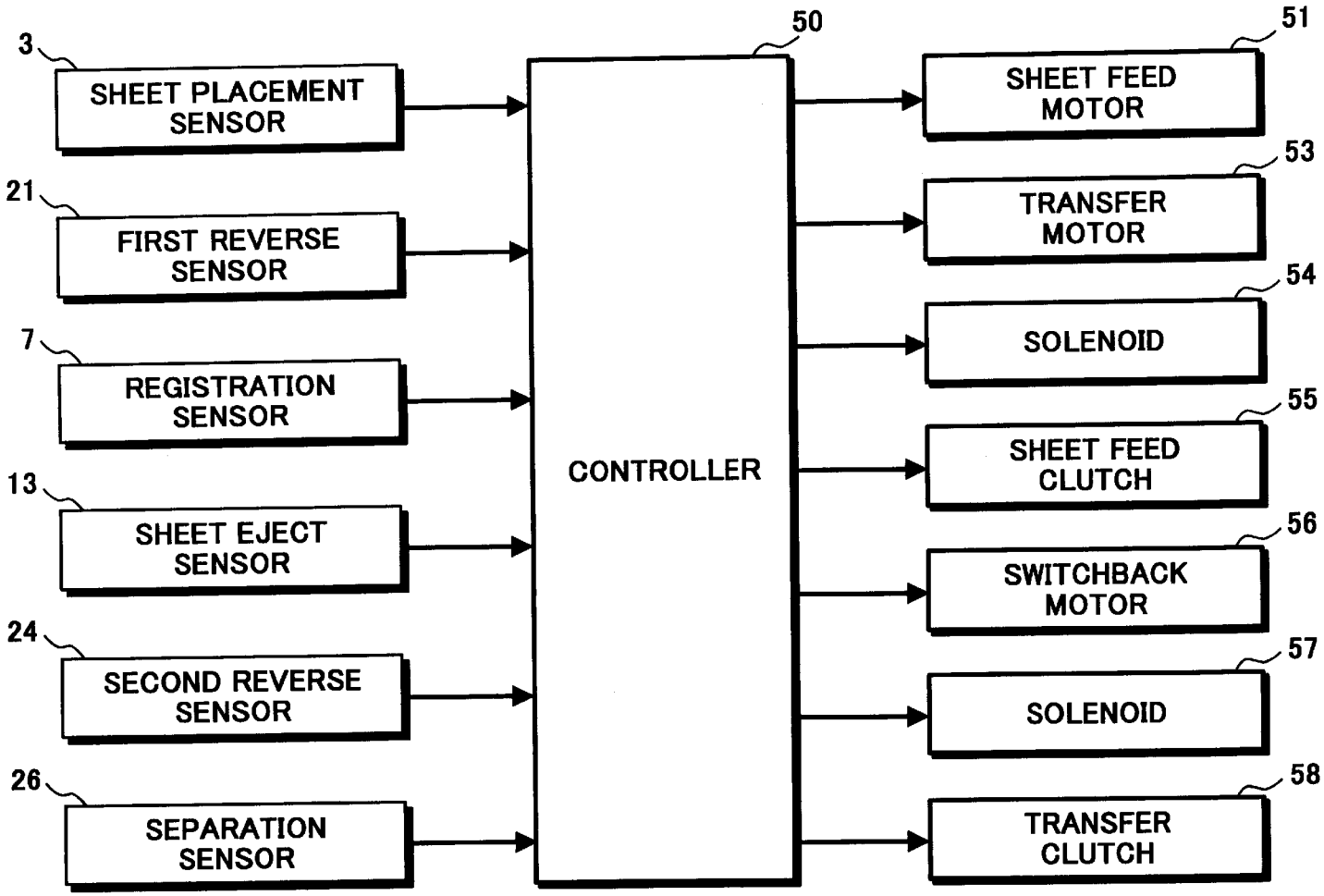
FIG. 2 is a block diagram showing sensors, motors, solenoids, and clutches used in the automatic sheet feed apparatus of FIG. 1.

On the sheet table 2, there is provided a sheet placement sensor 3 for detecting an original sheet set P placed on the sheet table 2 and sending a signal indicating a result of detection to the controller 50 (FIG. 2). Also, a separation sensor 26 is provided on the first sheet path 31 between the separation roller set 5 and the pull-out rollers 6. The separation sensor 26 detects separation of the original sheet P1 from the original sheet set P and sends a signal for indicating a result of the detection to the controller 50 (FIG. 2). At a receipt of such a signal from the separation sensor 26, the controller 50 (FIG. 2) controls the sheet feed clutch 55 (FIG. 2) to stop transmission of the driving force to the lower separation rollers 5*a*, as described above.

The transfer rollers 12 are arranged at a position downstream from the slit glass 61 of the copying apparatus 60 in the sheet transfer direction. The transfer rollers 12 are driven by the sheet feed motor 51 (FIG. 2) to further transfer the original sheet P1 to a pair of ejection rollers 14 which are provided at a position downstream from the transfer rollers 12. The ejection rollers 14 are connected to a transfer motor 53 (FIG. 2), e.g., a stepping motor or the like.

A switch pawl 16 is mounted downstream from the ejection rollers 14 through a second sheet path 17 in the sheet transfer direction. The switch pawl 16 switches its position between first and second positions. In FIG. 1, the first position is indicated by the solid-line and the second position is indicated by dotted lines. The switch pawl 16 at the second position connects the second sheet path 17 to a sheet eject tray 15. The switch pawl 16 at the first position connects the second sheet path 17 to a switchback path 20, or connects the switchback path 20 to a reverse bypass 22. To make this switching, the switch pawl 16 is moved by the action of a solenoid 54 (FIG. 2). Normally, the solenoid 54 does not bind the switch pawl 16 which therefore locates at the first position. But, the solenoid 54 causes the switch pawl 16 to move to the second position when it is activated upon receiving a signal from the controller 50.

Before describing the details of the switchback path 20 and the reverse path 22, an entire path for circulating an original sheet in the ADF 1 is explained. In a case of a duplex-printed (i.e., double-sided printed) original sheet, the ADF 1 circulates an original sheet three times. Normally, if a sheet is circulated, the sheet turns twice and it returns back to a starting place in the same orientation relative to top and bottom surfaces. The sheet turns one time only in the ADF 1, however, since the ADF 1 is provided with a switchback mechanism within the circulation route.

In a first circulation of the ADF 1, an original sheet is fed from the sheet table 2 and is reversed upside down, and the front-face of the sheet is read accordingly. In a second circulation, the sheet is reversed and the rear-face of the original sheet is read. The original sheet may be ejected straight after the rear-face reading operation. In the ADF 1, however, an order of the sheet and a succeeding sheet relative to the top and bottom orientation would become different in such a case. A third circulation is therefore needed to reverse and to eject the sheet. In the third circulation, the original sheet is reversed and is ejected in such an orientation that an order of the sheet and a succeeding sheet which comes later is maintained in the same manner as is on the sheet table 2.

In the above-mentioned first circulation, an original sheet fed from the sheet table 2 goes through the first sheet path 31, passing by the reading position on the slit glass 61, the second sheet path 17, the switchback path 20, the reverse path 22, and back to the first sheet path 31. Through the first sheet path 31, the original sheet is reversed. That is, the original sheet which lies in the front-face-up orientation on the sheet table 2 is reversed and is transferred to the reading position in the rear-face-up orientation, so that the front face of the original sheet faces the slit glass 1 so as to be read. After the front-face reading operation, the original sheet is moved to the switchback path 20 in which the direction of the original sheet is reversed so that the rear-face of the original sheet is turned up so as to be read next. Then, the original sheet is transferred to the reverse path 22 and ends the first circulation.

The second circulation in which the original sheet is moved and the rear-face thereof is read is performed in a manner similar to the above-described first circulation, except for arrangements for starting the first circulation of a succeeding sheet. More specifically, when the original sheet (now referred to as a preceding original sheet; i.e., the original sheet P1) is transferred to the switchback path 20 after the rear-face reading operation, the first circulation is started to feed a succeeding original sheet (i.e., the original sheet P2). Thus, the ADF 1 achieves an efficient sheet feeding operation. During the time when the front-face reading operation is performed relative to the succeeding original sheet, it is ensured that the preceding original sheet is in the reverse path 22 and/or the switchback path 20. After the front-face reading operation relative to the succeeding original sheet, the third circulation is performed to reverse and then to eject the preceding original sheet.

The ADF 1 achieves a compactness in a physical size as well as an efficient sheet feeding operation as described above. The compactness is realized by minimizing a length of the sheet circulation route. More specifically, the reverse path 22 is configured to have a length longer than a predetermined value to cover a typical sheet size (e.g., an A4 size) but shorter than another predetermined value to cover another typical sheet size (e.g., an A3 size). With the following techniques, the large-sized sheet can also be handled in an efficient manner.

In the switchback path 20, there is mounted an FR (forward and reverse) drive roller 18 paired with an FR (forward and reverse) driven roller 19. The FR drive roller 18 is connected to a switchback motor 56 (FIG. 2), e.g., a stepping motor or the like, which switches rotation of the FR drive roller 18 between clockwise and counterclockwise directions. When the FR drive roller 18 is driven in a clockwise direction, an original sheet coming from the second sheet path 17 is transferred to an innermost place of the switchback path 20. When the FR drive roller 18 is driven in a counterclockwise direction, an original sheet from the innermost place of the switchback path 20 is transferred to the reverse bypass 22. The FR driven roller 19 is connected to a solenoid 57 (FIG. 2), via a lever (not shown), which moves the FR driven roller 19 so as to make it contact with and apart from the FR drive roller 18 in accordance with a signal from the controller 50. Specifically, the FR driven roller 19 is held apart from the FR drive roller 18 by the action of the solenoid 57 (FIG. 2).

In the reverse bypass 22, a reverse roller set 23 is mounted. A lower side roller of the reverse roller set 23 is referred to as a lower reverse roller 23*a*. The lower reverse roller 23*a* is connected to a transfer clutch 58 (FIG. 2) for transmitting driving power from the transfer motor 53 (FIG. 2) to the lower reverse roller 23*a* in accordance with a signal from the controller 50. The transfer clutch 58 (FIG. 2) operates to stop transmitting power from the transfer motor 53 (FIG. 2) to the lower reverse roller 23*a*, for example, when an original sheet having a relatively large size (e.g., an A3 size sheet) is temporarily held along the switchback original sheet in this case.

A registration sensor 7 is provided downstream from the pull-out rollers 6 along the first sheet path 31 and a sheet eject sensor 13 is provided upstream from the ejection rollers 14 through the second sheet path 17 in the original sheet transferring direction. The registration sensor 7 and the sheet eject sensor 13 respectively detect leading edge (LE) and trailing edges (TE) of an original sheet and send a signal indicating a result of detection to the controller 50.

A first reverse sensor 21 is provided around an entrance of the reverse bypass 22. This first reverse sensor 21 detects an original sheet running through the second sheet path 17 towards the switchback path 20 and also detects an original sheet which moves from the switchback path 20 to the reverse bypass 22. In each event, the first reverse sensor 21 sends a signal indicating a result of the detection to the controller 50. A second reverse sensor 24 is provided downstream from the reverse roller set 23 along the reverse bypass 22 in the reverse-transferring direction and detects an original sheet running through the reverse bypass 22.

In FIG. 2, there are illustrated connections of the controller 50 to the above-described various sensors and mechanical driving elements, such as clutches, solenoids, and motors or the like. The controller 50 drives the sheet feed motor 51 and the sheet feed clutch 55 in accordance with the signals from the sheet placement sensor 3 and the separation sensor 26. Also, the controller 50 drives the sheet feed motor 51, the transfer motor 53, the solenoids 54 and 57, the switchback motor 56, and the transfer clutch 58 in accordance with the signals from the registration sensor 7, the sheet eject sensor 13, the first reverse sensor 21, and the second reverse sensor 24.

Next, examples of the sheet feeding operation of the ADF 1 are explained with reference to the timing charts of FIGS. 3 and 4. Both examples of FIGS. 3 and 4 operate a plurality of original sheets (i.e., the original sheets P1 and P2) each of which is printed on both sides. The example of FIG. 3 describes an operation when the original sheet is a large-sized sheet (e.g., an A3-sized sheet placed in a landscape orientation in the sheet transfer direction). The other example shown in FIG. 4 describes an operation when the original sheet is a small-sized sheet (e.g., an A4-sized sheet placed in a landscape and/or portrait orientation). When the original sheets is a small-sized sheet (e.g., an A4-sized sheet), an immediately preceding original sheet (e.g., the original sheet P1) can be forwarded throughout its length in the reverse bypass 22 on standby for a rear-face reading operation. However, when each of the original sheets P1 and P2 is a large-sized sheet (e.g., an A3-sized sheet), an immediately precedent original sheet (e.g., the original sheet P1) may remain in the switchback path 20 and a leading side of an immediately succeeding original sheet (e.g., the original sheet P2) will meet in the switchback path 20 with the precedent original sheet (e.g., the original sheet P1). These operations are further explained later.

Figure 3:
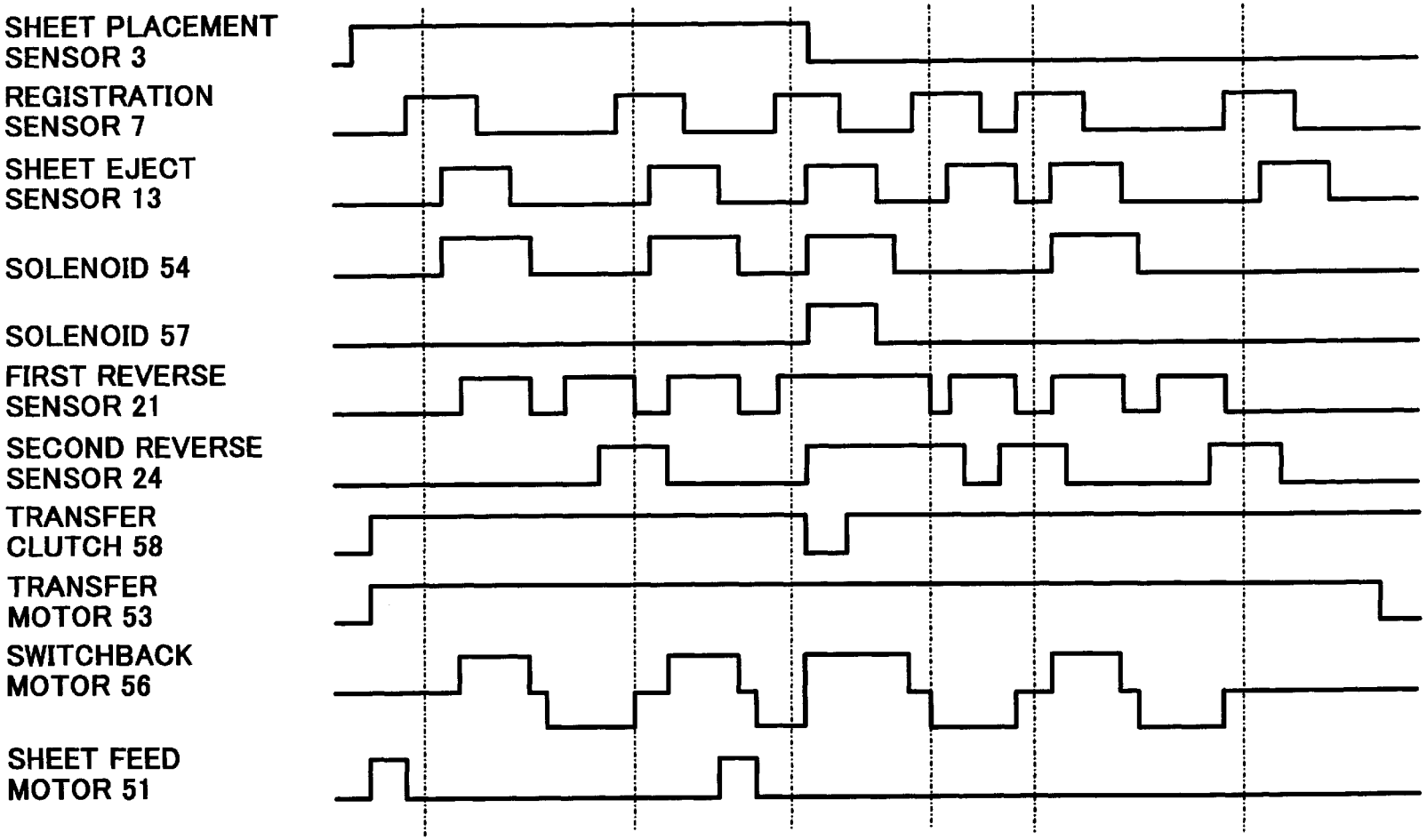
FIGS. 3 and 4 are timing charts for explaining examples of a sheet feeding operation of the automatic sheet feed apparatus of FIG. 1.
Figure 4:
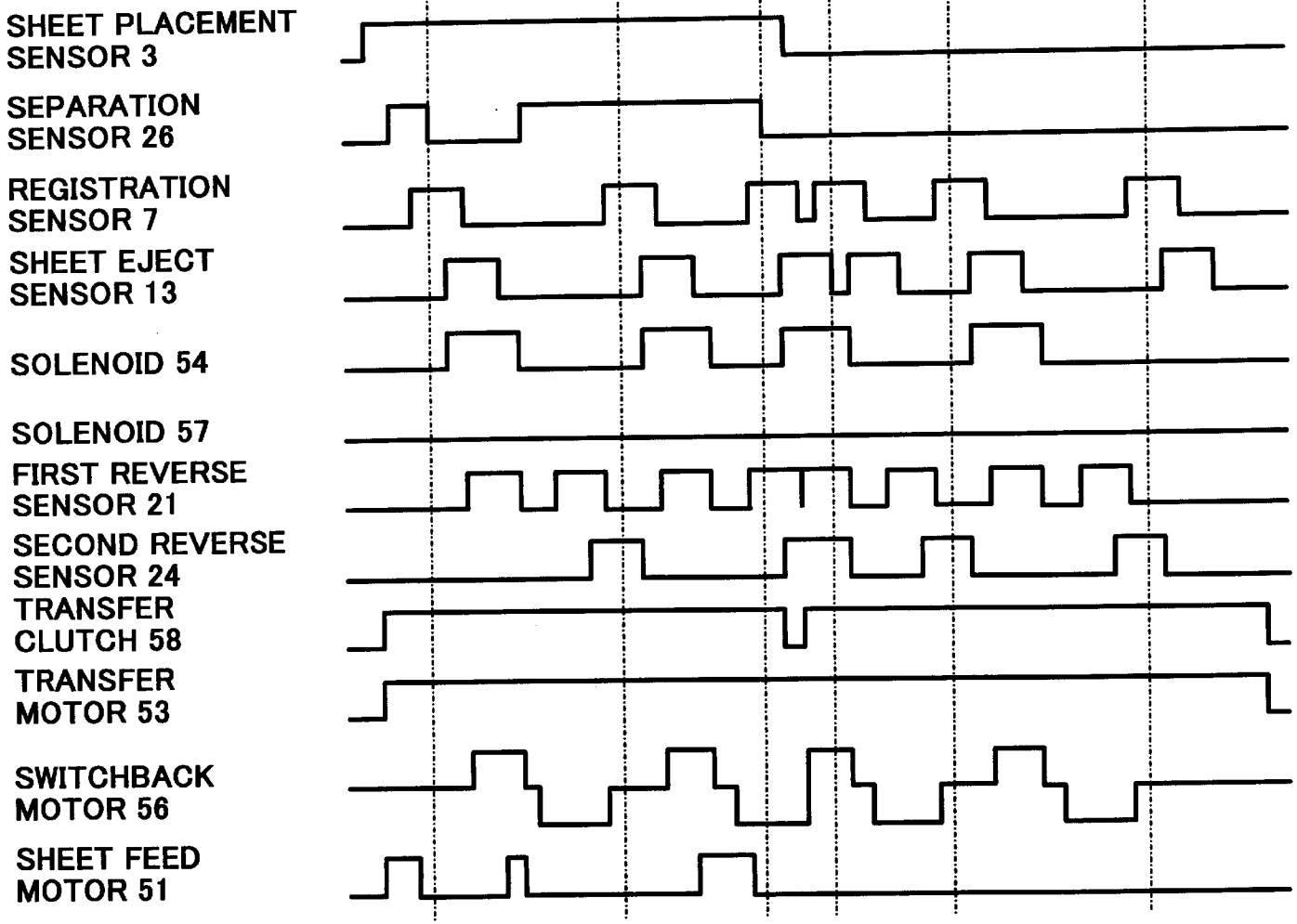

In addition, in FIGS. 3 and 4, reference characters A–F represents the reading position located on the slit glass 61 relative to various operations during the sheet feeding operation of the ADF 1, e.g., A represents a front-face reading operation on the original sheet P1, B represents a rear-face reading operation on the original sheet P1, C represents a front-face reading operation on the original sheet P2, D represents a sheet eject operation on the original sheet P1, E represents a rear-face reading operation on the original sheet P2, and F represents a sheet eject operation on the original sheet P2.

In FIG. 3, the sheet placement sensor 3 turns on (e.g., a high logic level signal) when it detects the original sheet set P placed in the front-face-up orientation on the sheet table 2 and turns off (e.g., a low logic level signal) by detecting no original sheet after the original sheet P2 is transferred from the sheet table 2.

The registration sensor 7 turns on (e.g., a high logic level signal) when it detects for a first time the leading edge of the original sheet P1 passing by through the first sheet path 31 land turns off (e.g., a low logic level signal) by detecting that the trailing edge of the original sheet P1 passes by. The registration sensor 7 turns on when it detects for a second time the original sheet P1. By this time, the original sheet P1 is subjected to the front-face reading operation, reversed into the rear-face-up orientation through the switchback path 20 and the reverse bypass 22, and returned to the first sheet path 31 in order to receive the rear-face reading operation. After that, the registration sensor 7 turns off when it detects the trailing edge of the original sheet P1 in the rear-face-up orientation passes by.

Then, the registration sensor 7 turns on when it detects for a first time the leading edge of the original sheet P2 which is fed for the front-face reading operation from the sheet table 2. When the trailing edge of the original sheet P2 passes by, the registration sensor 7 detects this and turns off. With such detection timing, the sheet ejection operation starts to eject the original sheet P1 temporarily held in the reverse bypass 22 after the rear-face reading operation. The registration sensor 7 turns on when it accordingly detects for a third time the original sheet P1 returning for the sheet ejection operation.

By this time, the original sheet P1 is subjected to the rear-face reading operation, returned into the front-face-up orientation through the switchback path 20 and the reverse bypass 22, held in the reverse bypass 22, and transferred to the first sheet path 31 in order to be ejected to the sheet eject tray 15. When the trailing edge of the original sheet P1 in the front-face-up orientation passes by, the registration sensor 7 detects this and turns off.

Further, the registration sensor 7 turns on when it sequentially detects the original sheet P2 passing by in the rear-face-up orientation and in the front-face-up orientation, as shown in FIG. 3. These operations are similar to the handling of the original sheet P1 as described above.

The sheet eject sensor 13 turns on (e.g., a high logic level signal) when it detects the leading edges of the original sheets P1 and P2 at the position downstream from the registration sensor 7. When each trailing edge of the original sheets P1 and P2 passes by, the sheet eject sensor 13 detects this and turns off (e.g., a low logic level signal). Also, the sheet eject sensor 13 turns on when it detects the leading edge of the original sheet P1 which is transferred from the reverse bypass 22 after the front-face reading operation or after the rear-face reading operation. When the trailing edge of the original sheet P1 passes by, the sheet eject sensor 13 detects this and turns off. During the above process, the original sheet P2 is picked up from the sheet table 2 and is fed to the first sheet path 31 with such timing when the sheet eject sensor 13 detects the trailing edge of the original sheet P1 after the rear-face reading operation.

The solenoid 54, which is normally not energized (e.g., a low logic level signal), is activated (e.g., a high logic level signal) with such timing when the sheet eject sensor 13 detects one of the leading edges of the original sheets P1 and P2 each of which is transferred to the sheet eject sensor 13 after the front-face reading operation or after the rear-face reading operation. While the solenoid 54 is not activated, the switch pawl 16 is not acted on by the solenoid 54 and stays at the first position. But, when the solenoid 54 is activated, it moves the switch pawl 16 from the first position to the second position. The activated solenoid 54 is released (e.g., a low logic level signal) with such timing when the transfer motor 53 is driven for a predetermined amount of rotation after the sheet eject sensor 13 detects the trailing edge of the original sheet P1 or P2 after the front-face reading operation or after the rear-face reading operation. Alternatively, the activated solenoid 54 may be released with such timing when the first reverse sensor 21 detects the trailing edge of the original sheet P1 or P2. By this release, the switch pawl 16 is accordingly moved from the second position back to the first position.

The solenoid 57, which is normally not energized (e.g., a low logic level signal), is activated (e.g., a high logic level signal) with such timing when the sheet eject sensor 13 detects the leading edge of the original sheet P2 which is transferred to the sheet eject sensor 13 after the front-face reading operation. While the solenoid 57 is not activated, the FR driven roller 19 is not acted on by the solenoid 57 and makes contact with the FR drive roller 18. But, when the solenoid 57 is activated, it moves the FR driven roller 19 away from the FR drive roller 18. The solenoid 57 is released (e.g., a low logic level signal) with such timing when the sheet eject sensor 13 detects the trailing edge of the original sheet P2 after the front-face reading operation. By this release, the FR driven roller 19 is accordingly moved away from the FR drive roller 18.

Each of the first and second reverse sensors 21 and 24 turns on (e.g., a high logic level signal) when it detects the leading edge of the original sheet P1 or P2 during the switchback transfer operation by the actions of the FR drive and driven rollers 18 and 19 and the switch pawl 16 after the front-face reading operation or after the rear-face reading operation. When the trailing edge of that original sheet P1 or P2 passes by, each of the first and second reverse sensors 21 and 24 detects this and thereby turns off (e.g., a low logic level signal). In addition, the first reverse sensor 21 turns on when it detects the leading edge of the original sheet P1 running through the first sheet path 17 towards the switchback path 20 and turns off by detecting the trailing edge thereof.

The transfer clutch 58 is activated (e.g., a high logic level signal) with such timing when the separation sensor 26 detects the leading edge of a first original sheet (i.e., the original sheet P1) and is deactivated (e.g., a low logic level signal) when the sheet feeding operation completes. During the time when the transfer clutch 58 is activated, the power of the transfer motor 53 is transmitted to the reverse roller set 23. In addition, the transfer clutch 58 is also deactivated (e.g., a low logic level signal) when the second reverse sensor 24 detects the leading edge of the original sheet P1 during the switchback transfer operation after the rear-face reading operation relative to the original sheet P1. Accordingly, the power of the transfer motor 53 is not transmitted to the reverse roller set 23 so that the reverse roller set 23 stops movement of the original sheet P1 which consequently lies in the reverse bypass 22. After that, the transfer clutch 58 is again activated when the registration sensor 7 detects the trailing edge of the original sheet P2. Upon this detection, the reverse roller set 23 transfers the original sheet P1 to the first sheet path 31. An alternative to providing the transfer clutch 58, is to provide a torque limiter (e.g., about 300 g-cm) or the like coupled to the FR drive roller 18.

The sheet feed motor 51 is turned on (e.g., a high logic level signal) to rotate with such timing when the sheet feeding operation starts to feed an original sheet (i.e., the original sheet P1) from the sheet table 2 when the sheet placement sensor 3 turns on, and is turned off (e.g., a low logic level signal) with such timing when the trailing edge of the original sheet is detected by the separation sensor 26.

The transfer motor 53 is turned on (e.g., a high logic level signal) to rotate with such a timing when the separation sensor 26 detects the leading edge of the original sheet P1 and is turned off (e.g., a low logic level signal) with such timing when the sheet feeding operation completes to read all the original sheets (i.e., the original sheets P1 and P2).

The switchback motor 56 is normally halted (e.g., an intermediate logic level signal) and is driven in the forward direction (e.g., a high logic level signal) with such timing when the first reverse sensor 21 (or the sheet eject sensor 13) detects one of the leading edges of the original sheets P1 and P2 each of which is transferred through the second sheet path 17 after the front-face reading operation or after the rear-face reading operation. Then, the switchback motor 56 is stopped (e.g., the intermediate signal) for a predetermined time period with such timing when the first reverse sensor 21 detects one of the trailing edges of the original sheets P1 and P2 each of which advances to the switchback path 20 after the front-face reading operation or after the rear-face reading operation. Thus, the original sheet P1 or P2 can be moved in the switchback path 20. Alternatively, the switchback motor 56 may be stopped (e.g., the intermediate signal) for a predetermined time period with such timing when the transfer motor 53 is driven for a predetermined amount of rotation each time after the sheet eject sensor 13 detects one of the trailing edges of the original sheets P1 and P2 after the front-face reading operation or the rear-face reading operation. After the predetermined time stop period, the switchback motor 56 is driven in the reverse direction (e.g., a low logic level signal) so as to start the switchback operation for moving the original sheet P1 or P2 from the switchback path 20 into the reverse path 22.

Referring now to FIG. 4, an operation when the original sheet is a small-sized sheet (e.g., an A4-sized sheet placed in a landscape orientation in the sheet transfer direction) is explained. In FIG. 4, the sheet placement sensor 3 turns on (e.g., a high logic level signal) when it detects the original sheet set P placed in the front-face-up orientation on the sheet table 2 and turns off (e.g., a low logic level signal) by detecting no original sheet after the original sheet P2 is transferred from the sheet table 2. The separation sensor 26 turns on (e.g., a high logic level signal) when it detects the original sheet (i.e., the original sheets P1 and P2).

The registration sensor 7 turns on (e.g., a high logic level signal) when it detects for a first time the leading edge of the original sheet P1 passing by through the first sheet path 31 and turns off (e.g., a low logic level signal) by detecting that the trailing edge of the original sheet P1 passes by. The registration sensor 7 turns on when it detects for a second time the original sheet P1. By this time, the original sheet P1 is subjected to the front-face reading operation, reversed into the rear-face-up orientation through the switchback path 20 and the reverse bypass 22, and returned to the first sheet path 31 in order to receive the rear-face reading operation. After that, the registration sensor 7 turns off when it detects the trailing edge of the original sheet P1 in the rear-face-up orientation passes by.

Then, the registration sensor 7 turns on when it detects for a first time the leading edge of the original sheet P2 which is fed for the front-face reading operation from the sheet table 2. When the trailing edge of the original sheet P2 passes by, the registration sensor 7 detects this and turns off. With such detection timing, the transfer clutch 58 is activated to transmit power of the transfer motor 53 to the reverse roller set 23 so that the sheet ejection operation starts to eject the original sheet P1 which is temporarily held in the reverse bypass after the rear-face reading operation. The registration sensor 7 turns on when it accordingly detects for a third time the original sheet P1 returning for the sheet ejection operation.

By this time, the original sheet P1 is subjected to the rear-face reading operation, returned into the front-face-up orientation through the switchback path 20 and the reverse bypass 22, held in the reverse bypass 22, and transferred to the first sheet path 31 in order to be ejected to the sheet eject tray 15. When the trailing edge of the original sheet P1 in the front-face-up orientation passes by, the registration sensor 7 detects this and turns off.

Further, the registration sensor 7 turns on when it sequentially detects the original sheet P2 passing by in the rear-face-up orientation and that in the front-face-up orientation, as shown in FIG. 3. These operations are made in manners similar to the handling of the original sheet P1 as described above.

The sheet eject sensor 13 turns on (e.g., a high logic level signal) when it detects the leading edges of the original sheets P1 and P2 at the position downstream from the registration sensor 7. When each trailing edge of the original sheets P1 and P2 passes by, the sheet eject sensor 13 detects this and turns off (e.g., a low logic level signal). Also, the sheet eject sensor 13 turns on when it detects the leading edge of the original sheet P1 which is transferred from the reverse bypass 22 after the front-face reading operation or after the rear-face reading operation. When the trailing edge of the original sheet P1 passes by, the sheet eject sensor 13 detects this and turns off. During the above process, the original sheet P2 is picked up from the sheet table 2 and is fed to the first sheet path 31 with such timing when the sheet eject sensor 13 detects the trailing edge of the original sheet P1 after the rear-face reading operation.

The solenoid 54, which is normally not energized (e.g., a low logic level signal), is activated (e.g., a high logic level signal) with such timing when the sheet eject sensor 13 detects one of the leading edges of the original sheets P1 and P2 each of which is transferred to the sheet eject sensor 13 after the front-face reading operation or after the rear-face reading operation. While the solenoid 54 is not activated, the switch pawl 16 is not acted on by the solenoid 54 and stays at the first position. But, when the solenoid 54 is activated, it moves the switch pawl 16 from the first position to the second position. The activated solenoid 54 is released (e.g., a low logic level signal) with such timing when the transfer motor 53 is driven for a predetermined amount of rotation after the sheet eject sensor 13 detects the trailing edge of the original sheet P1 or P2 after the front-face reading operation or after the fear-face reading operation. Alternatively, the activated solenoid 54 may be released with such timing when the first reverse sensor 21 detects the trailing edge of the original sheet P1 or P2. By this release, the switch pawl 16 is accordingly moved from the second position back to the first position.

The solenoid 57 for moving the FR driven roller 19 is not activated (e.g., a low logic level signal) the entire time. This is because the original sheet P1 is shorter than the predetermined value so as to be held throughout its length in the reverse bypass 22 on standby for a rear-face reading operation and, therefore, the leading side of the original sheet P2 does not meet in the switchback path 20 with the trailing side of the original sheet P1 temporarily held in the reverse bypass 22.

Each of the first and second reverse sensors 21 and 24 turns on (e.g., a high logic level signal) when it detects the leading edge of the original sheet P1 or P2 during the switchback transfer operation by the actions of the FR drive and driven rollers 18 and 19 and the switch pawl 16 after the front-face reading operation or after the rear-face reading operation. When the trailing edge of that original sheet P1 or P2 passes by, each of the first and second reverse sensors 21 and 24 detects this and thereby turns off (e.g., a low logic level signal). In addition, the first reverse sensor 21 turns on when it detects the leading edge of the original sheet P1 running through the first sheet path 17 towards the switchback path 20 and turns off by detecting the trailing edge thereof.

The transfer clutch 58 is activated (e.g., a high logic level signal) with such timing when the first reverse sensor 21 detects the leading edge of the original sheet P1 during the switchback operation after the front-face reading operation and in turn moves the lower reverse roller 23*a* to make contact with the other roller of the reverse roller set 23. Thereby, the power of the transfer motor 53 is transmitted to the reverse roller set 23. After that, the transfer clutch 58 is deactivated (e.g., a low logic level signal) when the second reverse sensor 24 detects the leading edge of the original sheet P1 during the switchback transfer operation after the rear-face reading operation. As a result, the power of the transfer motor 53 is not transmitted to the reverse roller set 23 so that the reverse roller set 23 stops movement of the original sheet P1 held in the reverse bypass 22.

Then, the transfer clutch 58 is again activated when the registration sensor 7 detects the trailing edge of the original sheet P2 fed from the first sheet path 31 during the time that the original sheet P1 is held in reverse path 22 after the rear-face reading operation. Thereby, the power of the transfer motor 53 is transmitted to the reverse roller set 23 so that the reverse roller set 23 again starts to move the original sheet P1 towards the registration sensor 7.

The sheet feed motor 51 is turned on (e.g., a high logic level signal) to rotate with such timing when the sheet feeding operation starts to feed each original sheet from the sheet table 2 when the sheet placement sensor 3 turns on and is turned off (e.g., a low logic level signal) with such timing when the trailing edge of the original sheet is detected by the separation sensor 26. In addition, the sheet feed motor 51 is also controlled such that the sheet feed motor 51 is turned on when sheet eject sensor 13 detects the trailing edge of the original sheet P1, and is turned off when the leading edge of the original sheet P2 is detected by the separation sensor 26. In this case, the separation of the succeeding sheet is performed early and the separated succeeding sheet is held for standby in the entrance of the first sheet path 31.

The transfer motor 53 is turned on (e.g., a high logic level signal) to rotate with such timing when the separation sensor 26 detects the leading edge of the original sheet P1 and is turned off (e.g., a low logic level signal) with such timing when the sheet feeding operation completes reading of all the original sheets (i.e., the original sheets P1 and P2).

The switchback motor 56 is normally halted (e.g., an intermediate signal) and is driven in the forward direction (e.g., a high logic level signal) with such timing when the first reverse sensor 21 (or the sheet eject sensor 13) detects one of the leading edges of the original sheets P1 or P2 each of which is transferred through the second sheet path 17 after the front-face reading operation or after the rear-face reading operation. The switchback motor 56 is then stopped (e.g., the intermediate signal) for a predetermined time period when the first reverse sensor 21 detects one of the trailing edges of the original sheets P1 and P2 each of which advances to the reverse path 22 after the front-face reading operation or the rear-face reading operation. Thus, the original sheet P1 or P2 can be moved into the switchback path 20. Alternatively, the switchback motor 56 may be stopped (e.g., the intermediate signal) for a predetermined time period with such timing when the transfer motor 53 is driven for a predetermined amount of rotation after the sheet eject sensor 13 detects the trailing edge of the original sheet P1 or P2 after the front-face reading operation or after the rear-face reading operation. After the predetermined stop period, the switchback motor 56 is driven in the reverse direction (e.g., a low logic level signal) so as to start the switchback operation for moving a sheet from the switchback path 20 into the reverse path 22.

During the switchback operation, the switchback motor 56 is stopped when the first reverse sensor 21 detects one of the trailing edges of the original sheets P1 and P2. The switchback motor 56 is driven forward again with the next rise of the first reverse sensor 2 1.

Figure 5A:
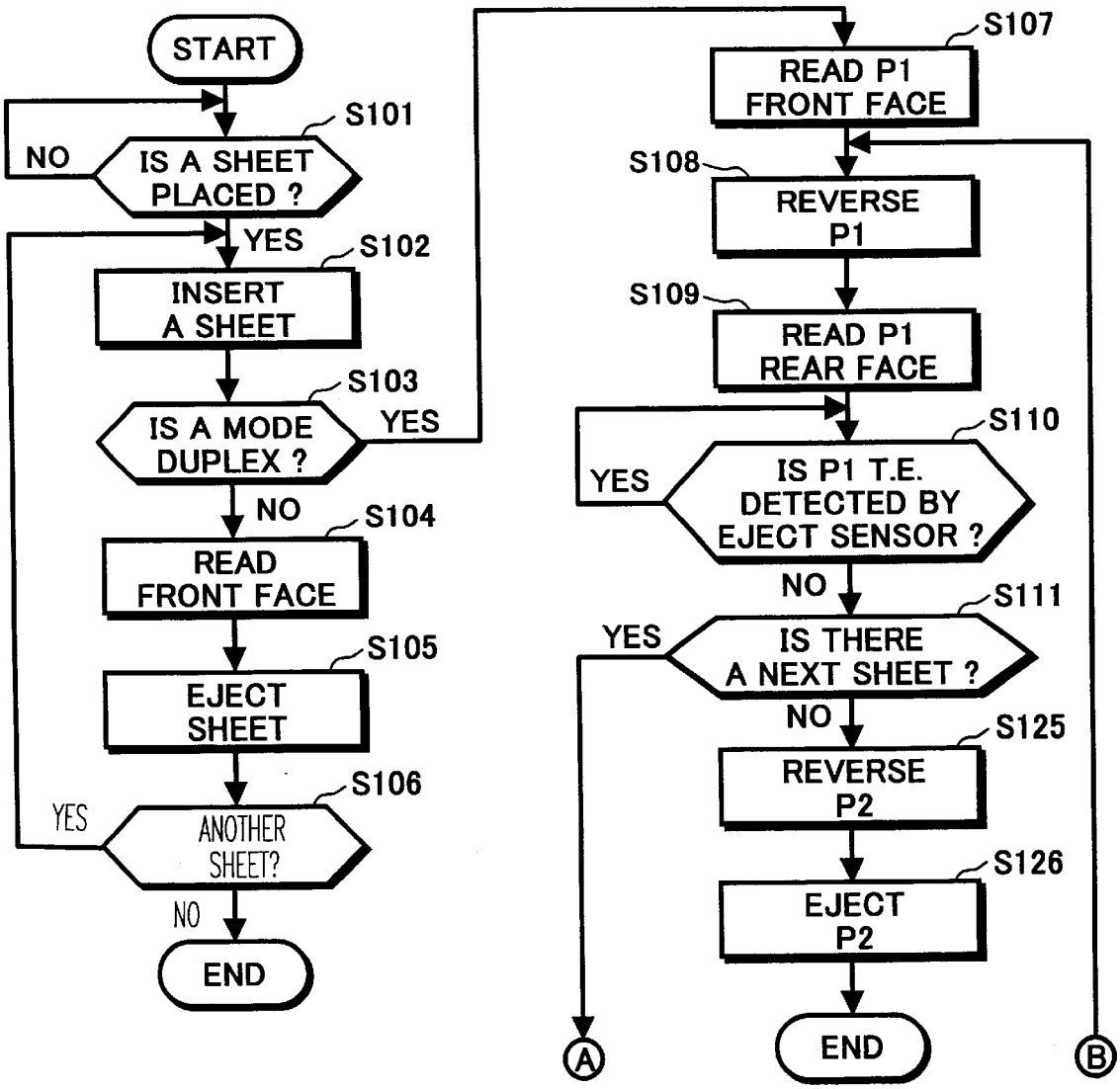
FIG. 5 is a flowchart for explaining details of the sheet feeding operation of FIGS. 3 and 4.
Figure 5B:
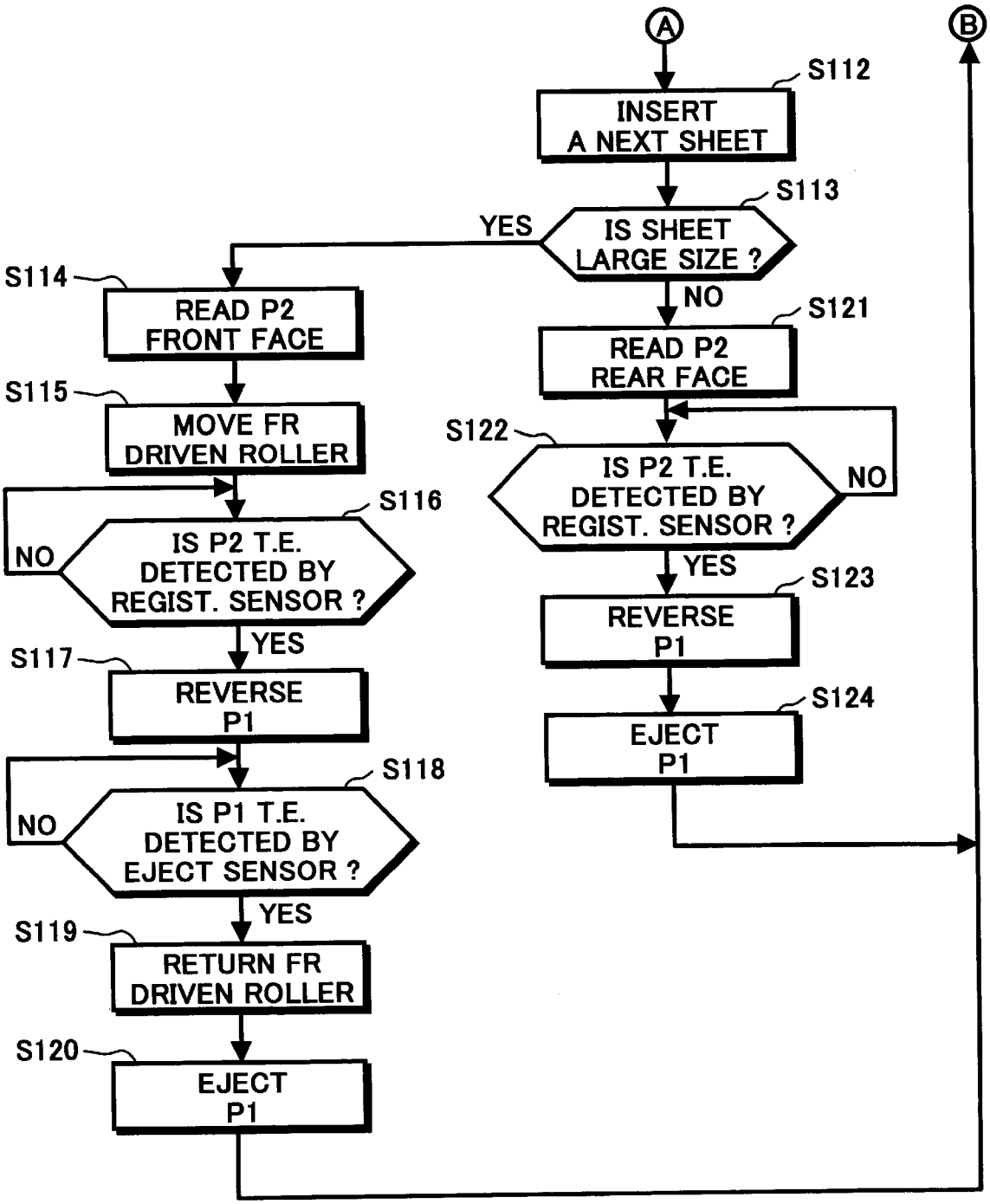

Next, an exemplary procedure of the sheet feeding operation of the ADF 1 is explained with reference to the flowchart of FIG. 5. In FIG. 5, the ADF 1 starts the sheet feeding operation by checking in Step S101 with the sheet placement sensor 3 whether the original sheet set P including the duplex-printed original sheets P1, P2, and so forth is placed on the sheet table 2. If the sheet placement sensor 3 detects an existence of the original sheet set P on the sheet table 2 and the check result of Step S101 is YES, the sheet placement sensor 3 sends a signal to the controller 50 and the process proceeds to Step S102. In Step S102, the controller 50 drives the sheet feed motor 51 to operate the separation and transfer mechanism upon the pressing of a copy start key mounted on a console panel (not shown) of the copying apparatus 60.

More specifically, during the operation of the separation and transfer mechanism in Step S102, the pick-up roller 4 contacts the uppermost original sheet P1 and picks it up towards the separation roller set 5 which then separates the original sheet P1 from the original sheet set P. When the separation sensor 26 detects the leading edge of the original sheet P1, the lower separation roller 5*a* is freed from the clockwise rotating force by the action of the feed clutch 55 so as to smoothly transfer the original sheet P1. Further, the separated original sheet P1 is transferred forward by the pull-out rollers 6 and transfer rollers 12. The sheet feed motor 51 is stopped when the registration sensor 7 detects the leading edge of the original sheet P1 so that the original sheet P1 is temporarily held at the registration sensor 7.

Then, in Step S103, the ADF 1 checks whether the operation mode is set to a simplex or duplex reading operation through an instruction from, for example, at the console panel of the copying apparatus 60. If the mode is set to the simplex reading operation and the check result of Step S103 is NO, the process proceeds to Step S104 in which the front-face of the original sheet P1 is read by the image reading mechanism 62 of the copying apparatus 60. That is, in Step S104, the controller 50 of the ADF 1 drives the sheet feed motor 51 in synchronism with a timing signal sent from the copying apparatus 60 to rotate the transfer rollers 12 so as to further move the original sheet P1. At this time, the copying apparatus 60 turns on the exposure lamp 63 to emit light. Thus, the front face of the original sheet P1 is read.

In Step S105, the controller 50 drives the ejection rollers 14 to further feed the original sheet P1 and releases the solenoid 54 to switch the position of the switch pawl 16 back to the first position. Accordingly, after the simplex reading operation the original sheet P1 is further moved with the transfer rollers 12 and the ejection rollers 14 towards the sheet eject tray 15. As a result, the original sheet P1 is ejected on the sheet eject tray in the rear-face-up orientation. After that, in Step S106, the controller 50 checks to see if there is a next sheet. If there is an original sheet, which is the original sheet P2, successive to the original sheet P1 and the check result of Step S106 is YES, the process returns to Step S102 and repeats the same procedure therefrom for the original sheet P2. If there is no further original sheet detected on the sheet table 2, the process ends.

If the mode is set to the duplex reading operation and the check result of Step S103 is YES, the process proceeds to Step S107 in which the front-face of the original sheet P1 is read by the image reading mechanism 62 of the copying apparatus 60 in the manner similar to that of the above-described simplex reading operation. In Step S108, the controller 50 performs the switchback operation in which the controller 50 drives the ejection rollers 14 to further feed the original sheet P1 and drives the solenoid 54 to hold the switch pawl 16 at the second position. Then, the controller 50 drives the switchback motor 56 to rotate the FR drive roller 18 clockwise. The original sheet P1 is accordingly fed into the switchback path through the second sheet path 17. Then, the controller 50 reverse drives the switchback motor 56 to rotate the FR drive roller 18 counterclockwise and releases the solenoid 54 to return the switch pawl 16 back to the first position. The original sheet P1 is thus fed into the reverse path 22 in the reverse direction and in the rear-face-up orientation. As a result, the original sheet P1 is transferred to the reading position one again. Then, in Step S109, the rear-face of the original sheet P1 is read by the image reading mechanism 62 of the copying apparatus 60 in the manner similar to that of the front-face reading operation previously performed. In this way, the ADF 1 performs the rear-face reading operation relative to the original sheet P1 after performing the front-face reading operation.

In Step S110, the controller 50 checks if the sheet eject sensor 13 is turned off. That is, the original sheet is farther transferred to the switchback path 20 after the rear-face reading operation and the sheet eject sensor 13 is turned off when the trailing edge of the original sheet P1 passes by the sheet eject sensor 13. If the sheet eject sensor 13 is turned off and the check result of Step S110 is YES, the process proceeds to Step S111 in which the controller 50 checks if there is the next sheet.

If there is a next sheet, the process proceeds to Step S112 and the controller 50 drives the sheet feed motor 51 to feed the next original sheet P2 into the first sheet path 31. When the original sheet P2 is fed into the first sheet path 31, the switchback motor 56 is stopped for a relatively short time period and the original sheet P1 is temporarily held in the switchback path 20. After that, the switchback motor 56 is reversely driven and the original sheet P1 is moved into the reverse path 22 from the switchback path 20. Then, in Step S113, the controller 50 checks if the original sheet P has a predetermined size (e.g., an A3 size) or a smaller size (e.g., an A4 size).

This size check of Step S113 is to allow the controller 50 to perform the sheet feeding operation in an efficient manner in accordance with the sheet size so determined. The controller 50 accordingly controls the operation of the FR drive roller 18 and the FR driven roller 19 based on the check result. In a case of a large-sized sheet (e.g., an A3 sheet placed in the longitudinal direction), the controller 50 moves the FR drive roller 19 away from the FR drive roller 18. As a result, the trailing edge of the large-sized original sheet P1 is released from the FR drive and driven rollers 18 and 19 while the leading edge of the original sheet P1 is fed in the reverse path 22. At the same time, the controller 50 releases the transfer clutch 58 to free the leading edge of the original sheet P1 from the reverse roller set 23. As a result, the long-sized original sheet P1 stops and lies both in the reverse path 22 and the switchback path 20. Thus, the trailing edge of the original sheet P1 in the switchback path 20 meets with the original sheet P2 which is moved into the switchback path 20.

Checking the length of the original sheet in Step S113 can be performed in a relatively easy manner. For example, the controller 50 can detect both leading and trailing edges of each sheet. Also, the controller 50 can count the number of driving pulses of the stepping motor (i.e., the sheet feed motor 51 or the transfer motor 53) needed to move the sheet from the leading and trailing edges and calculate the number of driving pulses with the information of a transfer amount per one driving pulse. In this way, the length of the sheet can be calculated.

If the original sheet P1 has a large size (e.g., an A3 size) and the check result of Step S113 is YES, the process proceeds to Step S114. In Step S114, the original sheet P2 is fed to the reading position at which the front-face of the original sheet P2 is then read by the image reading mechanism 62 of the copying apparatus 60. At this time, the advanced original sheet P1 is held in the reverse path 22 in the way as described above. The original sheet P2 is further moved to the switchback path 20 through the second sheet path 17 and via the switch pawl 16 which is set to the second position. During this transfer, the sheet eject sensor 13 detects the leading edge of the original sheet P2. With such detection timing, in Step S115, the controller 50 drives the solenoid 57 to move the FR driven roller 19 away from the FR drive roller 18. Thereby, the trailing edge of the original sheet P1 stops in the switchback path 20 even during the time when the original sheet P2 enters into the gap between the FR drive and driven rollers 18 and 19.

In Step S116, the controller 50 checks if the registration sensor 7 detected the trailing edge of the original sheet P2. If the registration sensor 7 detects the trailing edge of the original sheet P2 and the check result of Step S116 is YES, the process proceeds to Step S117 in which the controller 50 releases the transfer clutch 58 to move the original sheet P1 to the first sheet path 31.

Then, in Step S118, the controller 50 checks if the eject sensor 13 detected the trailing edge of the original sheet P2 during the time that the front-face of the original sheet P2 is being read. If the eject sensor 13 detects the trailing edge of the original sheet P2 and the check result of Step S118 is YES, the process proceeds to Step S119. In Step S119, with such timing of such detection in Step S118 by the eject sensor 13, the controller 50 turns off the solenoid 57 which then makes the FR driven roller 19 contact with the FR drive roller 18. The trailing edge of the original sheet P1 and the leading edge of the original sheet P2 are thereby pressed together and moved by the FR drive and driven rollers 18 and 19 in the directions opposite to each other. In Step S120, the original sheet P1 is transferred to the sheet eject tray 15.

Then, the process proceeds to Step S108 in which the original sheet P2 is transferred by the FR drive and driven rollers 18 and 19 into the switchback path 20 in the rear-face-up orientation after the front-face reading operation. During this transfer operation in Step S108, the trailing edge of the original sheet P2 is detected by the sheet eject sensor 13 and passes by the first reverse sensor 21. With this timing, the switchback motor 56 reverse drives the FR drive roller 18 which then rotates counterclockwise. The original sheet P2 is therefore moved to the reading position in the rear-face-up orientation through the reverse path 22 and the first sheet path 31. In Step S109, the rear-face of the original sheet P2 is read by the image reading mechanism 62 of the copying apparatus 60 in the manner similar to that of the front-face reading operation previously performed. In this way, the ADF 1 performs the rear-face reading operation relative to the original sheet P2 after performing the front-face reading operation.

After the rear-face reading operation in Step S109, the original sheet is further transferred to the switchback path 20 after the rear-face reading operation and the sheet eject sensor 13 is turned off when the trailing edge of the original sheet P1 passes by the sheet eject sensor 13. Then, in Step S110, the controller 50 checks if the sheet eject sensor 13 is turned off. If the sheet eject sensor 13 is turned off and the check result of Step S110 is YES, the process proceeds to Step S111 in which the controller 50 checks if there is the next sheet. However, in this case, the original sheet set P has no further original sheet after the original sheet P2 and the result of Step S111 is NO.

The process accordingly proceeds to Step S125 in which the switchback motor 56 reverse drives the FR drive roller 18 which then rotates counterclockwise when the trailing edge of the original sheet P2 is detected by the sheet eject sensor 13 and passes by the first reverse sensor 21. The original sheet P2 is therefore moved to the reading position in the rear-face-up orientation through the reverse path 22 and the first sheet path 31. Then, in Step S126, the original sheet P2 is further transferred through the second sheet path 17 and via the switch pawl 16 and is ejected to the sheet eject tray 15. The process then ends. In this way, the duplex reading operation for the large-sized and duplexprinted original sheet is performed If the original sheet P1 has a relatively small size and the check result of Step S113 is NO, the process proceeds to Step S121. In Step S121, the original sheet P2 is fed to the reading position at which the front-face of the original sheet P2 is then read by the image to reading mechanism 62 of the copying apparatus 60. At this time, the advanced original sheet P1 is held in the reverse path 22. The original sheet P2 is further moved to the switchback path 20 through the second sheet path 17 and via the switch pawl 16 which is set to the second position. During this transfer, the sheet eject sensor 13 detects the leading edge of the original sheet P2.

In Step S122, the controller 50 checks if the registration sensor 7 detected the trailing edge of the original sheet P2 as the front-face reading operation proceeds. If the registration sensor 7 detects the trailing edge of the original sheet P2 and the check result of Step S122 is YES, the process proceeds to Step S123 in which the controller 50 reverse drives the switchback motor 56 to rotate the FR drive roller 18 counterclockwise. The original sheet P1 held in the reverse path 22 is accordingly transferred into the first sheet path 31 through the reverse path 22. In Step S124, the original sheet P1 is transferred to the sheet eject tray 15, as a result. Then, the process proceeds to Step S108 and the controller 50 performs the operation through Steps S108 to S111 and Steps 125 and S126 in a manner similar to the operation performed for the large-sized original sheet set P as described above. In this way, the duplex reading operation for the duplex-printed original sheet having a small size (e.g., an A4 size) is performed.

Referring to FIGS. 6A–6K, further details of the duplex reading operation of the ADF 1 when reading the large-sized sheet is described. In this example, each sheet (i.e., the original sheets P1, P2) included in the original sheet set P is double-sided printed and has a relatively large size (e.g., an A3 sheet). Such an A3-sized original sheet set P is placed on the sheet table 2 such that the longitudinal side thereof is parallel to the direction of the sheet transfer. Also, in this example, the original sheet P2 is inserted into the sheet path after the original sheet P1 has experienced both front-face and rear-face reading operations.

In this example, a way for transferring a sheet from the duplex-printed original sheet set P to the reading position is merely similar to that for the simplex-printed original sheet. Specifically, when the reading operation in the duplex reading mode is started with the original sheet set P placed on the sheet table 2, the original sheet P1 is picked up and is transferred for a first time to the reading position through the first sheet path 31, which procedure is similar to that for the simplex-printed original sheet. The reading operation is then performed on the front-face of the original sheet P1. During this operation, the controller 50 drives the solenoid 54 to move the switch pawl 16 to the second position so as to send forward the original sheet P1 to the switchback path 20 through the second sheet path 17 via the switch pawl 16 and the sheet eject rollers 14 after the front-face reading operation.

Figure 6A:
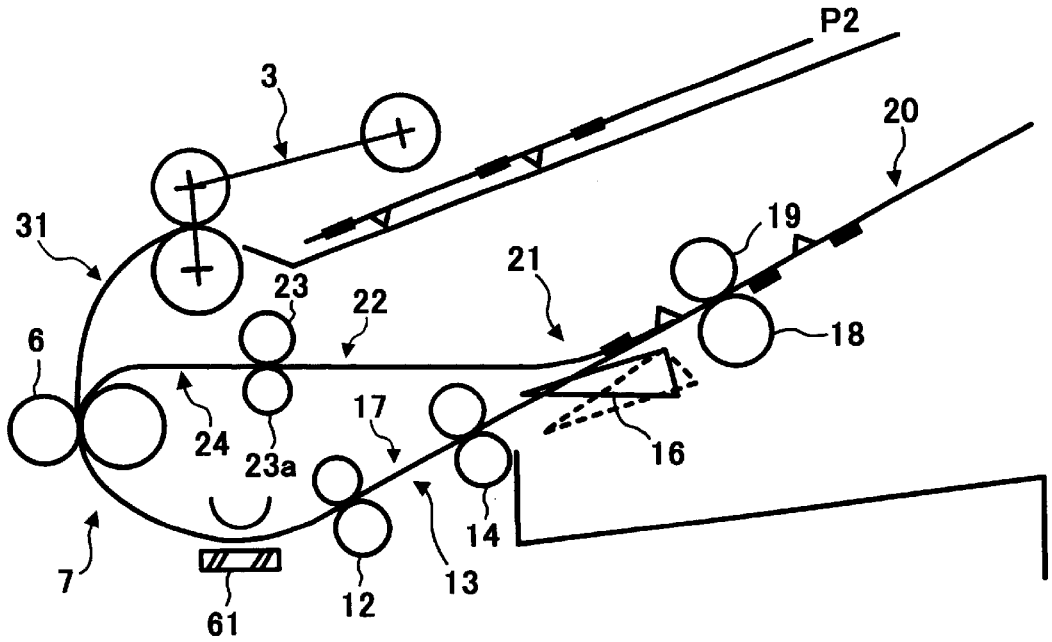
FIGS. 6A–6K are illustrations for explaining further details of the sheet feeding operation in a case of feeding large-sized sheets.

Accordingly, the original sheet P1 is transferred to the switchback path 20 with the FR drive and driven rollers 18 and 19. At this time, the FR drive roller is driven by the switchback motor 56 to rotate clockwise and contacts the FR driven roller 19 which is not acted on by the solenoid 57. Then, the controller 50 stops driving the switchback motor 56 to stop the rotation of the FR drive motor 18 for a predetermined time period and releases the solenoid 54 to move the switch pawl 16 to the first position when the first reverse sensor 21 detects the trailing edge of the original sheet P1. At this time, the original sheet P1 having passed through the front-face reading operation stays in the switchback path 20 in the rear-face-up orientation and the original sheet P2 stays on the sheet table 2 in the front-face-up orientation, as shown in FIG. 6A.

Then, the controller 50 reverse drives the switchback motor 56 to rotate the FR drive roller 18 counterclockwise so as to transfer the original sheet P1 to the reverse path 22 from the switchback path 20. The original sheet P1 is further moved in turn by the reverse roller set 23 and the pull-out rollers 6. Thus, the original sheet P1 is brought back for a second time to the reading position located on the slit glass 9 through the reverse path 22 and the first sheet path 31. Then, the reading operation is performed on the rear-face of the original sheet P1 at the reading position.

During the above operation, the controller 50 receives a signal indicating that the first reverse sensor 21 detected the trailing edge of the original sheet P1. The controller 50 then activates the solenoid 54 to move the switch pawl 16 to the second position and, also, forward drives the switchback motor 56 to rotate the FR drive roller 18 clockwise. The original sheet P1 is thereby moved forward again to the switchback path 20 through the second sheet path 17 after the rear-face reading operation.

The controller 50 then detects an event that the first reverse sensor 21 detects the trailing edge of the original sheet P1 which has passed through the front-face and rear-face reading operations. With this timing, the controller 50 halts the rotation of the FR drive roller 18 so that the original sheet P1 stays in the switchback path 20 being held on the trailing edge thereof by the FR drive and driven rollers 18 and 19.

Figure 6B:
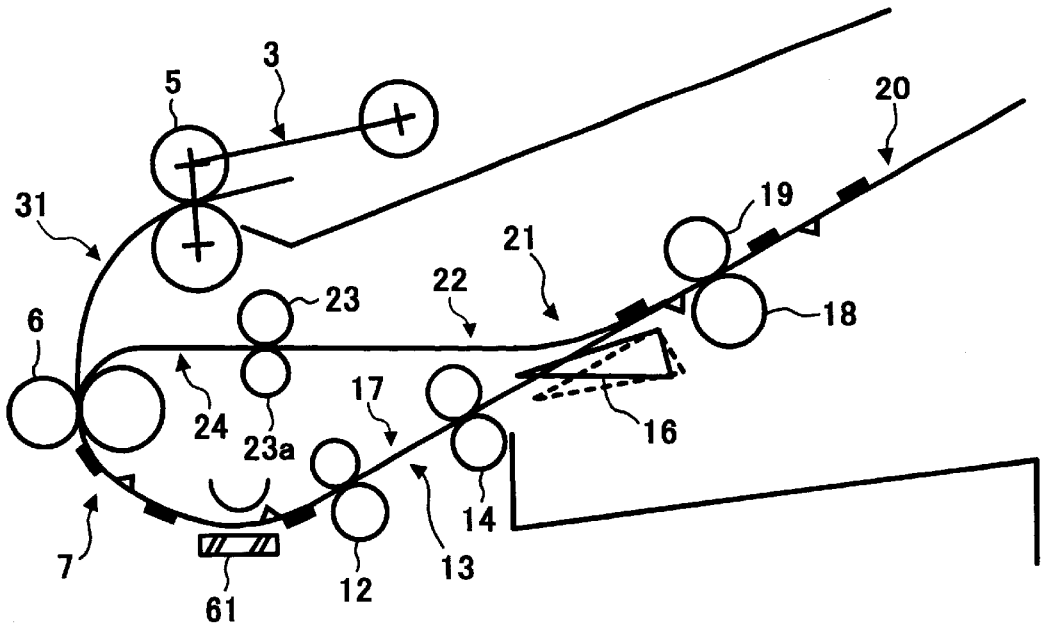

During the above operation, the controller 50 receives a signal indicating that the sheet eject sensor 13 detected the trailing edge of the original sheet P1 after the rear-face reading operation. The controller 50 then drives the sheet feed motor 51 to operate the pick-up roller 4 and the separation roller set 5 so as to bring the original sheet P2 into the first sheet path 31. The original sheet P2 is further transferred to the reading position and the reading operation is started on the front-face of the original sheet P2. At this time, the original sheet P1 having passed through the front-face and rear-face reading operations stays in the switchback path 20 in the front-face-up orientation and the original sheet P2 runs on the slit glass 9 in the rear-face-up orientation, as shown in FIG. 6B.

Figure 6C:
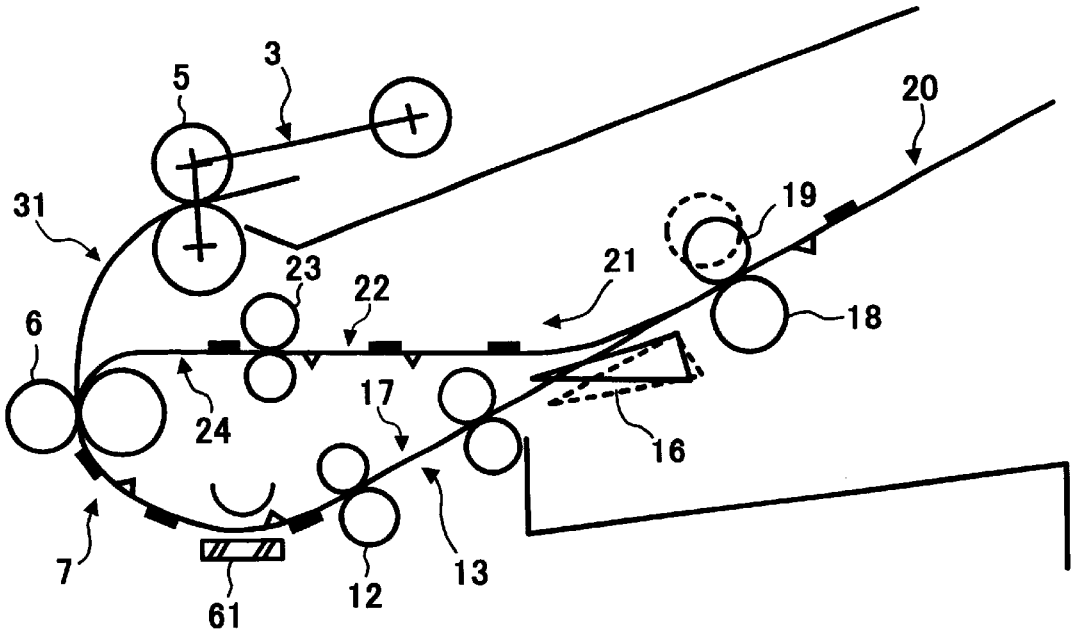

During the above operation, upon detecting an event that the registration sensor 7 detects the leading edge of the original sheet P2, the controller 50 deactivates the solenoid 54 to move the switch pawl 16 to the first position and reverse drives the switchback motor 56 to rotate counterclockwise the FR drive roller 18 which is halted. By this reverse rotation of the FR drive roller 18, the original sheet P1 held in the switchback path 20 is transferred to the reverse path 22. When the trailing edge of the original sheet P1 is detected by the second reverse sensor 24, the controller 50 deactivates the transfer clutch 58 to free the reverse roller set 23 and, at the same time, activates the solenoid 57 to separate the FR driven roller 19 from the FR drive roller 18. Thereby, the original sheet P1 is held in the reverse path 22 and the trailing edge thereof stays in the switchback path 20 free from the FR drive and driven roller 18 and 19. At this time, as shown in FIG. 6C, the FR drive roller 19 is located in a position indicated by the dotted-line. As also shown in FIG. 6C, the original sheet P1 having passed through the front-face and rear-face reading operations stays in the reverse path 22 in the front-face-up orientation and the original sheet P2 runs on the slit glass 9 in the rear-face-up orientation.

Figure 6D:
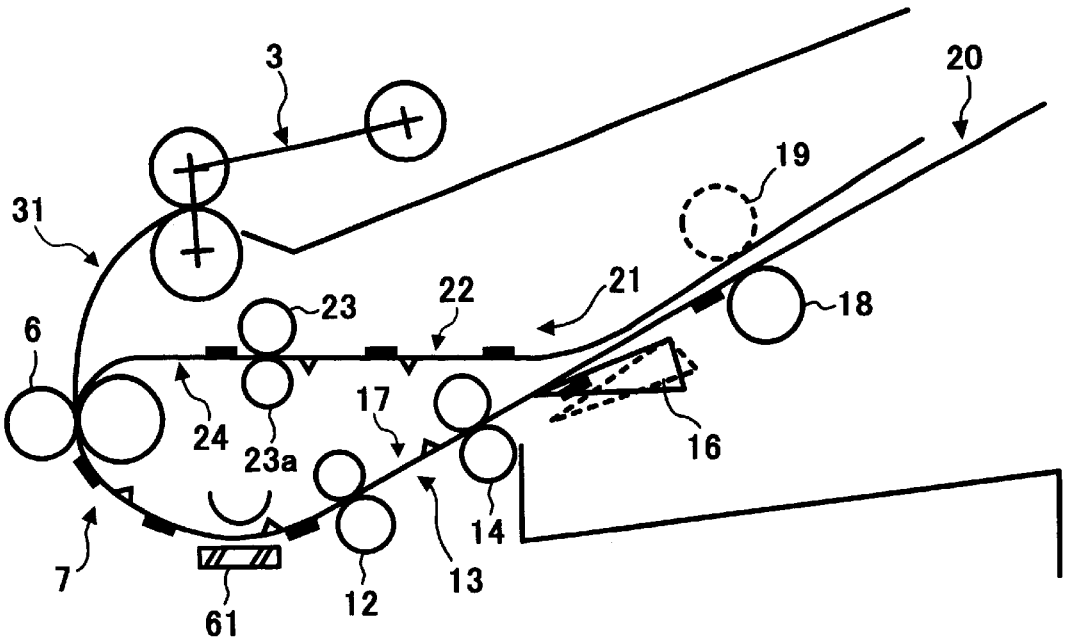

Then, the controller 50 detects an event that the sheet eject sensor 13 detects the leading edge of the original sheet P2 which presently undergoes the front-face reading operation. Upon such a detection, the controller 50 activates the solenoid 54 to move the switch pawl 16 to the second position and drives the switchback motor 56 to rotate the FR drive roller 18 clockwise. Thus, the original sheet P2 passing through the second sheet path 17 is guided to the gap between the FR drive and driven rollers 18 and 19 located in the switchback path 20. At this time, since the trailing edge of the original sheet P1 lies between the FR drive and driven rollers 18 and 19, the original sheet P2 slides along the trailing edge of the original sheet P1 from the bottom and enters into the gap between the FR drive and driven rollers 18 and 19, as shown in FIG. 6D.

Figure 6E:
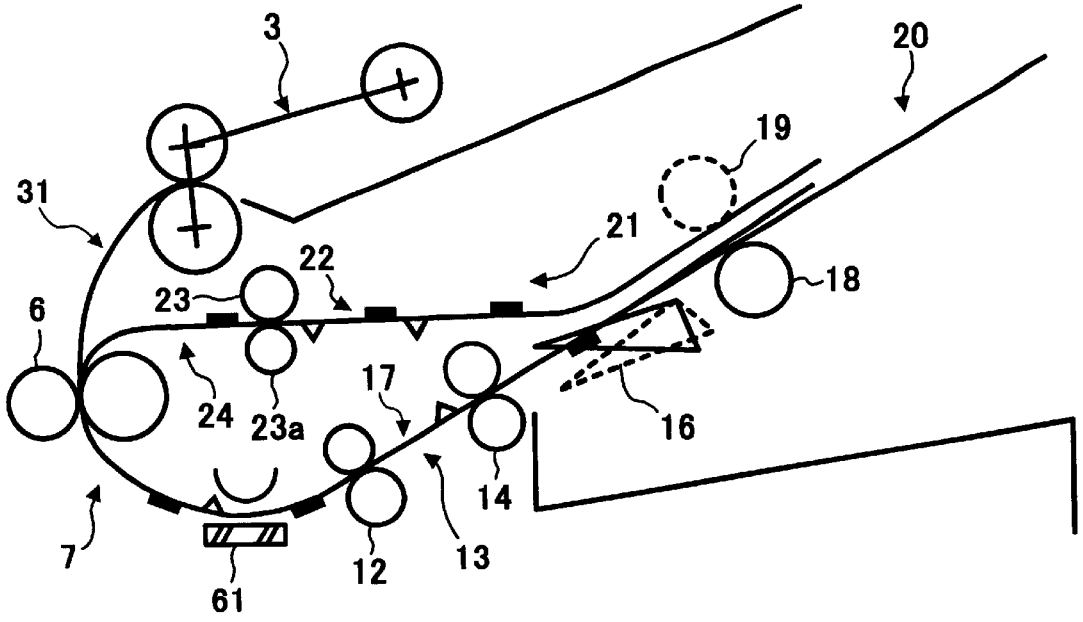

After that, the controller 50 detects an event that the registration sensor 7 detects the trailing edge of the original sheet P2 during the front-face reading operation with respect to the original sheet P2. With this timing, the controller 50 activates the transfer clutch 58 to transmit the driving force to the lower reverse roller 23*a* so that the reverse roller set 23 is driven to transfer the original sheet P1 to the pull-out rollers 6 located in the first sheet path 31. This state of the operation is shown in FIG. 6E.

Figure 6F:
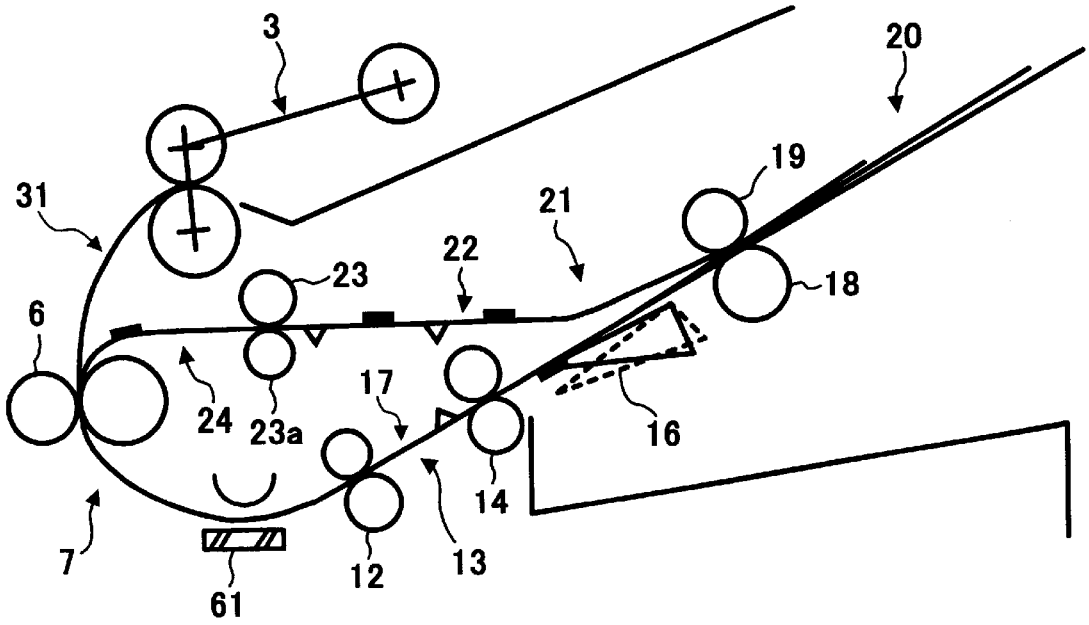

Then, the front-face reading operation completes and the original sheet P2 is further moved into the switchback path 20 such that the sheet eject sensor 13 detects the trailing edge thereof. Upon such a detection, the controller 50 deactivates the solenoid 57 to move the FR driven roller 19 to contact the FR drive roller 18. The FR driven roller 19 is thereby rotated by the rotation of the FR drive roller 18. Accordingly, the original sheet P1 and the original sheet P2 are held by the FR drive and driven rollers 18 and 19. At this time, the original sheet P1 receives the rotating force from the reverse roller set 23 under the pressure from the FR driven roller 19 at the trailing edge thereof and the original sheet P2 receives the rotating force from the FR drive roller 18 which rotates in the direction opposite to that of the lower reverse roller 23*a*. As a result, the original sheet P1 is transferred to the first sheet path and the original sheet P2 is transferred into the switchback path 20. This occurs because a friction of the FR drive roller 18 is set to a value higher than that of the FR driven roller 19. At this time, the original sheet P1 having passed through the front-face and rear-face reading operations is moved into the first sheet path 31 and the original sheet P2 having passed through the front-face reading operation is further transferred to the switchback path 20, which states are shown in FIG. 6F.

Figure 6G:
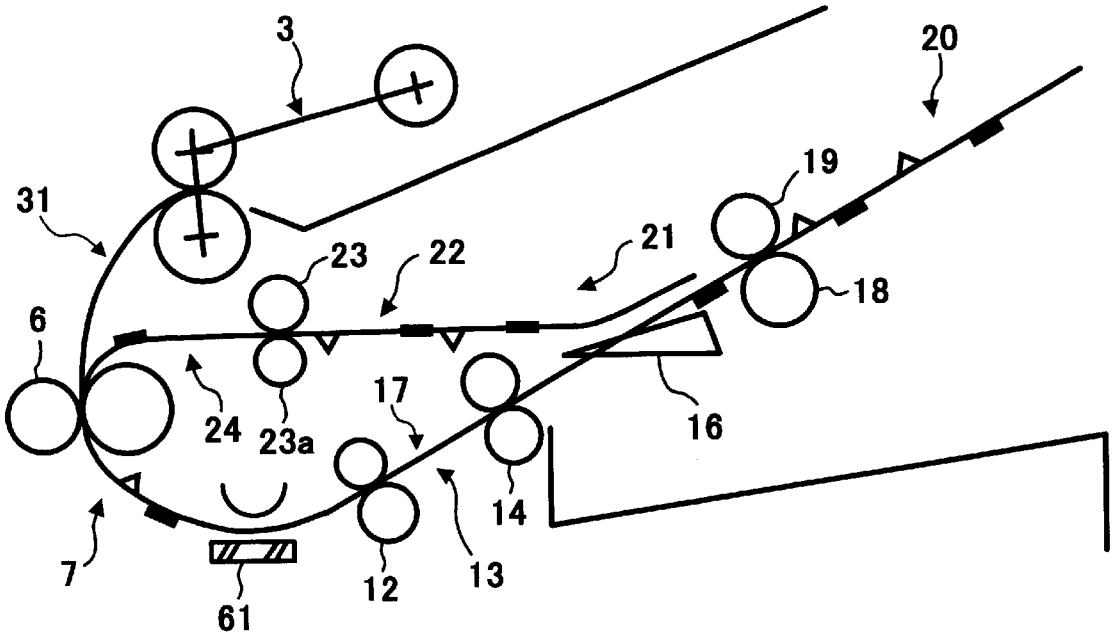

Then, the controller 50 detects an event that the sheet eject sensor 13 detects the trailing edge of the original sheet P2 after the front-face reading operation. Upon such a detection, the controller 50 counts a number of driving pulses of the switchback motor 56 so as to detect the time when the trailing edge of the original sheet P2 passes by the first reverse sensor 21. The controller 50 then stops the switchback motor 56 to halt the rotation of the FR drive roller 18 when the trailing edge of the original sheet P2 passes by the first reverse sensor 21. At the same time, the controller 50 deactivates the solenoid 54 to move the switch pawl 16 to the first position. Thus, as shown in FIG. 6G, the switch pawl 16 located in the first position, the original sheet P1 having passed through the front-face and rear-face reading operations is transferred through the first sheet path 31, and the original sheet P2 having the front-face reading operation is held in the switchback path 20 with the FR drive and driven rollers 18 and 19 which are halted.

Figure 6H:
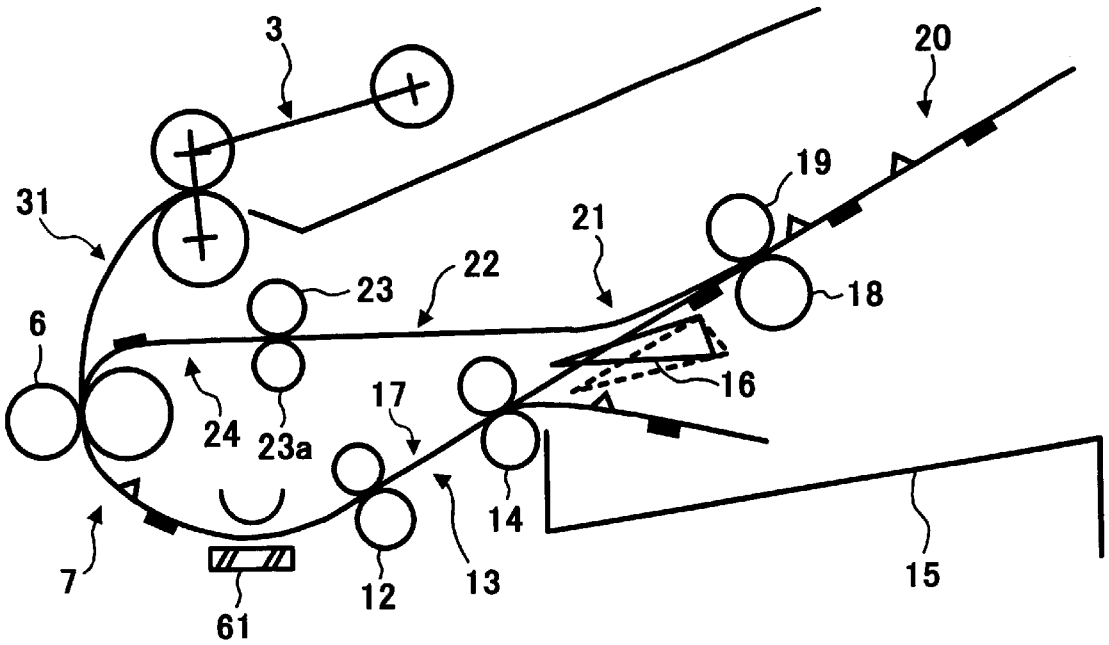

After that, the controller 50 detects an event that the second reverse sensor 24 detects the trailing edge of the original sheet P1 passing through the fist sheet path 31 and then reverse drives the switchback motor 56 to rotate the FR drive roller 18 counterclockwise. Thus, as shown in FIG. 6H, the original sheet P1 having passed through the front-face and all rear-face reading operations is transferred towards the sheet eject tray 15 through the second sheet path 17 via the switch pawl 16 positioned at the first position indicated by the dotted line. As also shown in FIG. 6H, the original sheet P2 having passed through the front-face reading operation is moved into the reverse path 22 via the switch pawl 16 positioned at the first position indicated by the dotted line.

Figure 6I:
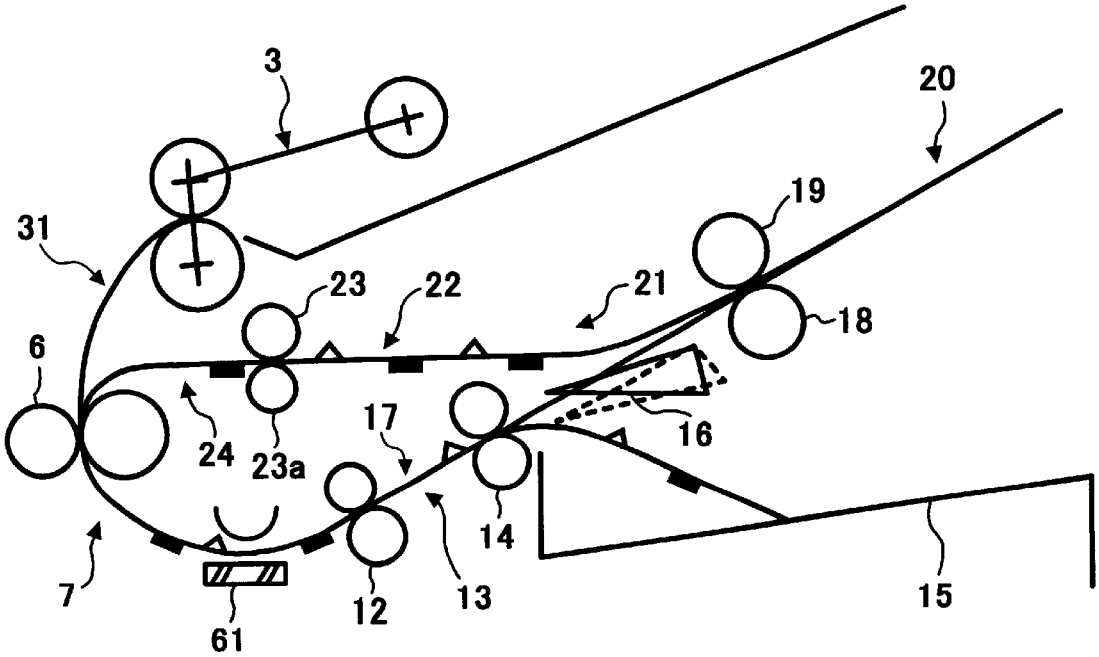
Figure 6J:
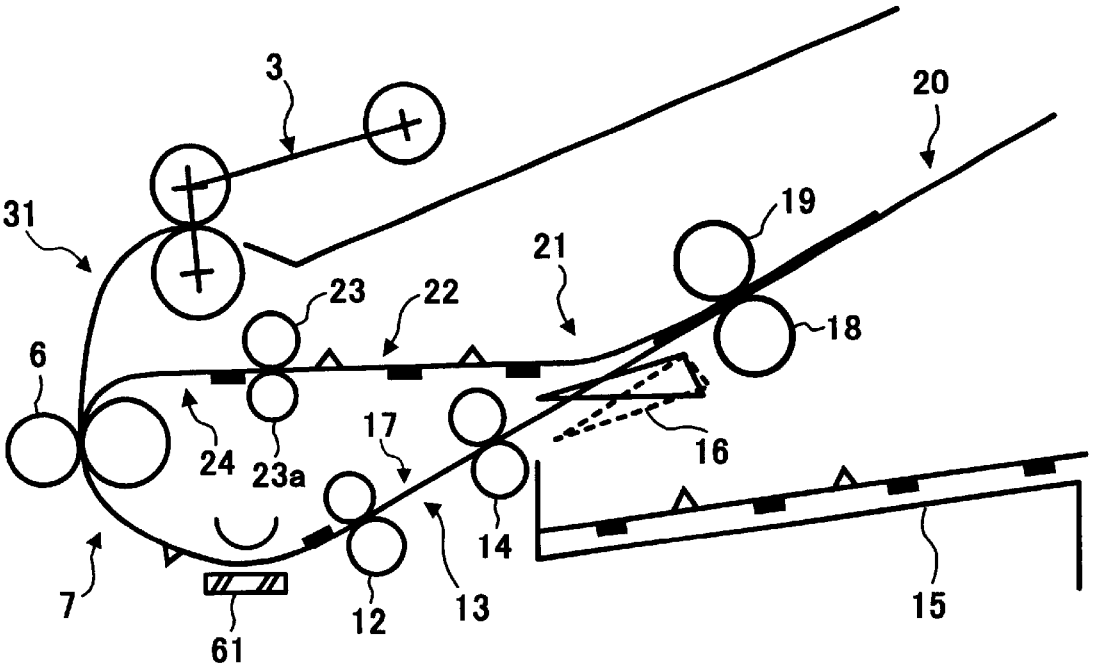

The controller 50 then detects an event that the second reverse sensor 24 detects the leading edge of the original sheet P2 and in turn stops the switchback motor 56 and the transfer motor 53 so as to halt the FR drive roller 18 and the lower reverse roller 23*a*. Accordingly, the original sheet P1 is further advanced to the sheet eject tray 15 and the original sheet P2 is suspended in the reverse path 22, as shown in FIG. 6I. The trailing edge of the original sheet P1 is then detected by the registration sensor 7. With this detection timing, the controller 50 starts the reading operation with respect to the rear-face of the original sheet P2. During the reading operation relative to the original sheet P2, the sheet eject sensor 13 detects the leading edge of the moving original sheet P2. Upon such a detection, the controller 50 activates the solenoid 54 to move the switch pawl 16 to the second position and forward drives the switchback motor 56 to rotate the FR drive roller 18 clockwise. Thereby, as shown in FIG. 6J, the original sheet P2 is transferred to the switchback path 20, after the rear-face reading operation, through the second sheet path 17 via the switch pawl 16 positioned at the second position indicated by the dotted-line. By this time, the original sheet P1 is completely ejected from the second sheet path 17 and is held in the rear-face-up orientation in the sheet eject tray 15, as also shown in FIG. 6J.

Figure 6K:
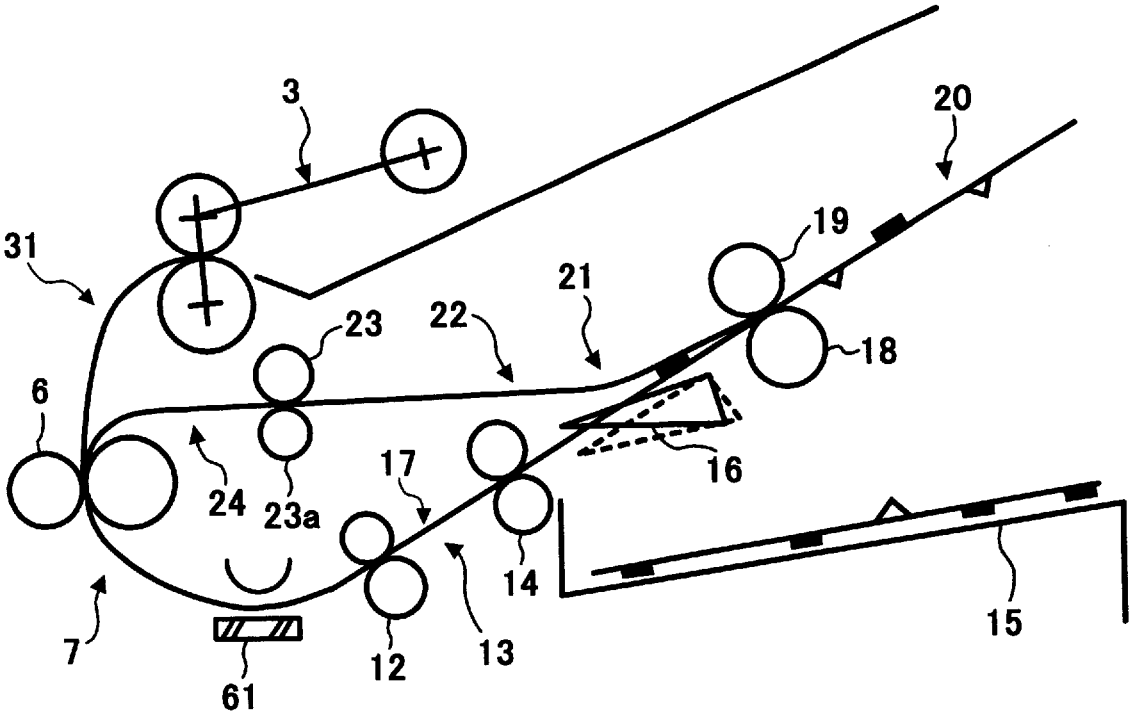

Then, the controller 50 detects an event that the trailing edge of the original sheet P2 passes by the entrance of the switchback path 20 from the second sheet path 17 after the front-face and rear-face reading operations. This event can be detected using the first reverse sensor 21 or the sheet eject sensor 13. In latter case, the controller 50 needs a calculation of the transfer amount of the original sheet based on the number of the driving pulses of the switchback motor 56. Upon a detection of such an event that the trailing edge of the original sheet P2 passes by the entrance of the switchback path 20, the controller 50 stops the at switchback motor 56 to halt the FR drive roller 18 and deactivates the solenoid 54 to move the switch pawl to the first position indicated by the solid-line, as shown in FIG. 6K. Subsequently, the controller 50 reverse drives the switchback motor 56 to rotate the FR drive roller counterclockwise. Thus, the original sheet P2 is transferred to the second sheet path 17 through the reverse path 22 and the first sheet path 31, and is then ejected from the second sheet path 17 to the sheet eject tray 15, in the same manner as the original sheet P1 has been handled.

Referring now to FIGS. 7A–7F, further details of the duplex reading operation of the ADF 1 when reading the short-sized sheet is described. In this example, each sheet (i.e., the original sheets P1, P2) included in the original sheet set P is double-sided printed and has a relatively small size (e.g., an A4 sheet). Such an A4-sized original sheet set P is placed on the sheet table 2 such that the longitudinal sides thereof are transverse relative to the sheet transfer direction. Also, in this example, the original sheet P2 is inserted into the sheet path after the original sheet P1 has experienced both front-face and rear-face reading operations.

In this example, a way for transferring the duplex-printed original sheet set P to the reading position is similar to that for the simplex-printed original sheet. When the reading operation in the duplex reading mode is started with the original sheet set P placed on the sheet table 2, the original sheet P1 is picked up and is transferred for a first time to the reading position located on the slit glass 9 through the first sheet path 31. The reading operation is then performed on the front-face of the original sheet P1. During this operation, the controller 50 drives the solenoid 54 to move the switch pawl 16 to the second position so as to send forward the original sheet P1 to the switchback path 20 through the second sheet path 17 via the switch pawl 16 and the sheet eject rollers 14 after the front-face reading operation.

Figure 7A:
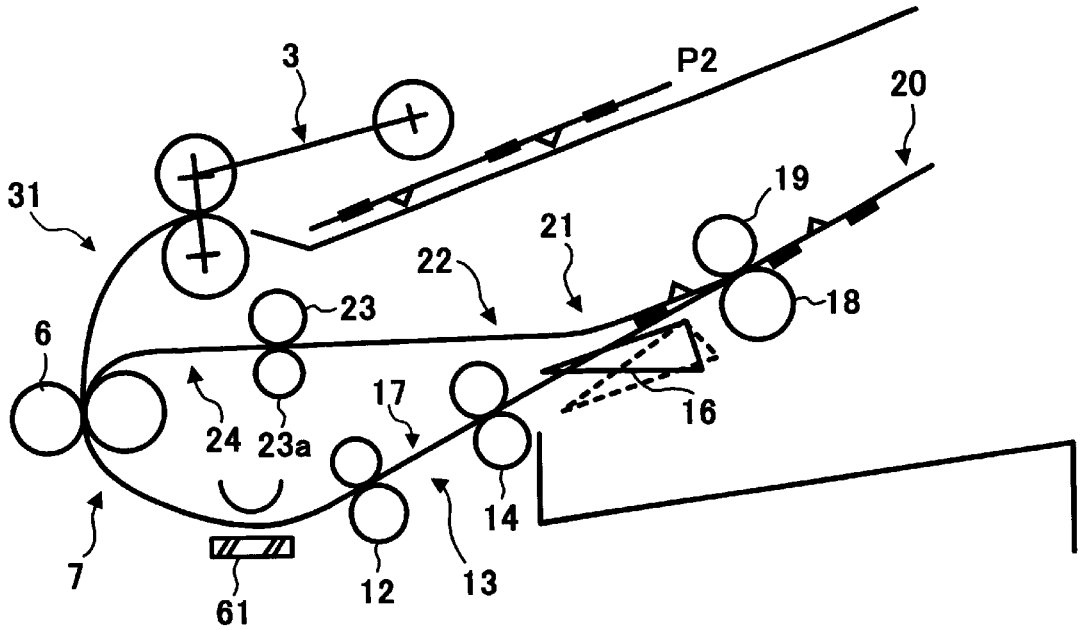
FIGS. 7A–7F are illustrations for explaining further details of the sheet feeding operation in a case of feeding small-sized sheets.

Accordingly, the original sheet P1 is transferred to the switchback path 20 with the FR drive and driven rollers 18 and 19. At this time, the FR drive roller is driven by the switchback motor 56 to rotate clockwise and contacts the FR driven roller 19 which is not acted on by the solenoid 57. Then, the controller 50 stops driving the switchback motor 56 to stop the rotation of the FR drive motor 18 for a predetermined time period and releases the solenoid 54 to move the switch pawl 16 to the first position when the first reverse sensor 21 detects the trailing edge of the original sheet P1. Thus, the original sheet P1 having passed through the front-face reading operation stays in the switchback path 20 in the rear-face-up orientation and the original sheet P2 stays on the sheet table 2 in the front-face-up orientation, as shown in FIG. 7A.

Then, the controller 50 reverse drives the switchback motor 56 to rotate the FR drive roller 18 so as to transfer the original sheet P1 held in the switchback path 20 to the reverse path 22 from the switchback path 20 in the reverse direction. The original sheet P1 is further transferred for a second time to the reading position with the reverse roller set 23 and the pull-out rollers 6. Then, the reading operation with respect to the rear-face of the original sheet P1 is performed. The sheet eject sensor 13 detects the leading edge of the original sheet P1 which is further moved through the second sheet path 17. Upon such a detection, the controller 50 activates the solenoid 54 to move the switch pawl 16 to the second position and forward drives the switchback motor 56 to rotate the FR drive roller 18 clockwise. Thereby, the original sheet P1 is guided again to the switchback path 20 after the front-face and rear-face reading operations.

Figure 7B:
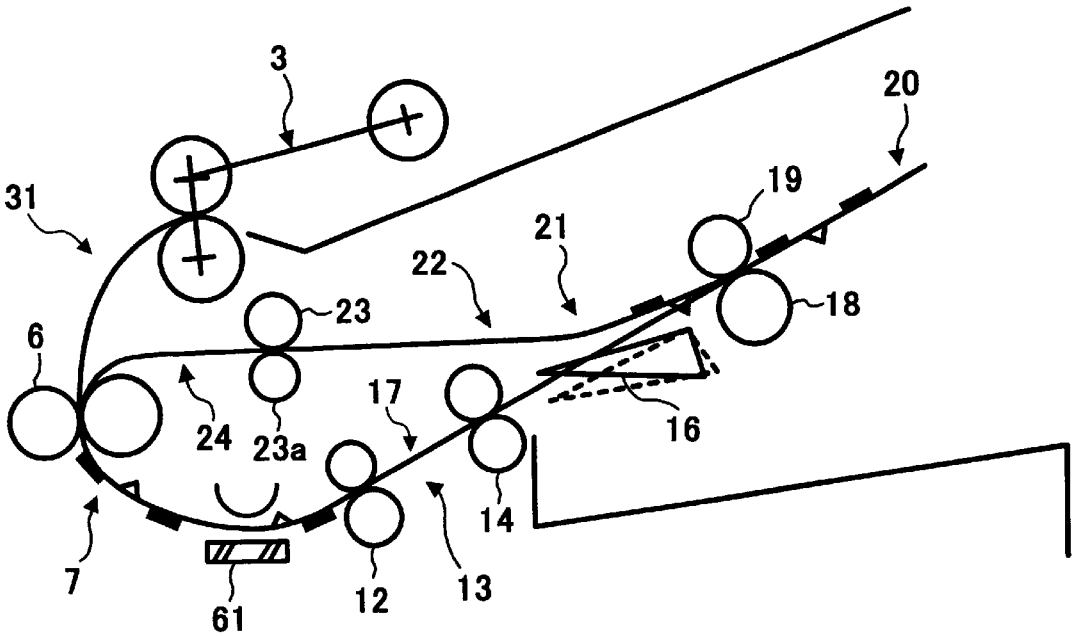

During the above operation, the sheet eject sensor 13 detects the trailing edge of the original sheet P1. Upon this detection, the controller 50 drives the sheet feed motor 51 to operate the pick-up roller 4 and the separation roller set 5, thereby bringing the original sheet P2 into the first sheet path 31. Then, the pull-out rollers 6 further moves the original sheet P2 to the reading position on the slit glass 9 and, in turn, the reading operation relative to the front-face of the original sheet P2 is started. At this time, the original sheet P1 having passed through the front-face and rear-face reading operations is transferred into the switchback path 20 and the original sheet P2 passing by the reading position, as shown in FIG. 7B.

Figure 7C:
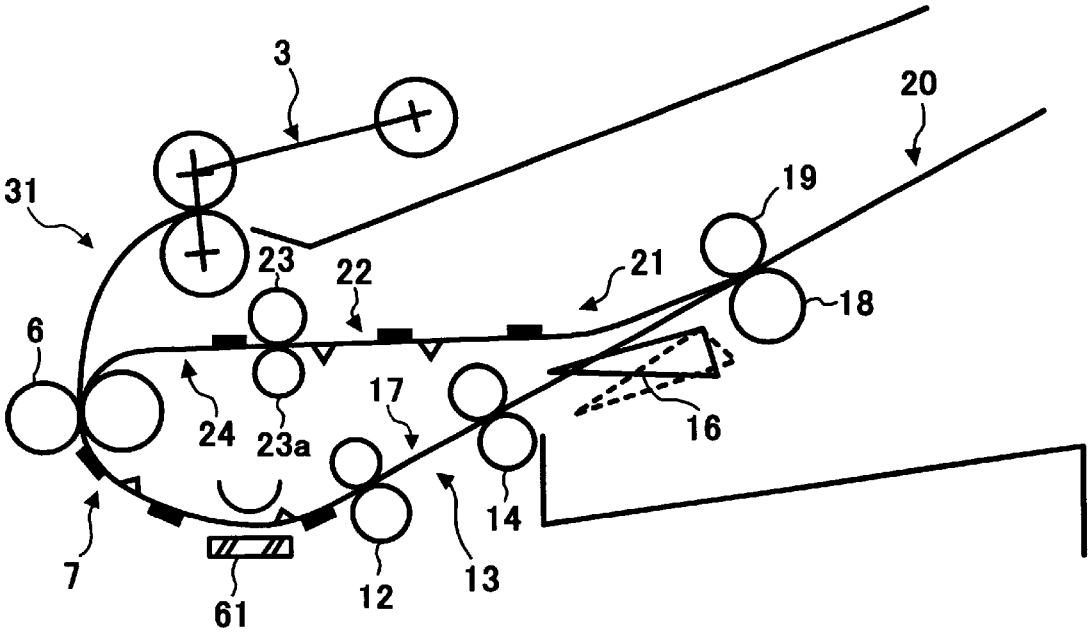

During the time that the original sheet P1 is moved into the switchback path 20, the first reverse sensor 21 detects the trailing edge of the original sheet P1. Upon such a detection, the controller 50 deactivates the solenoid 54 to move the switch pawl 16 to the first position and reverse drives the switchback motor 56 to rotate the FR drive roller 18 counterclockwise. Thereby, the original sheet P1 is transferred to the reverse path 22. When the second reverse sensor 24 detects the leading edge of the original sheet P1, the controller 50 deactivates the transfer clutch 58 to free the reverse roller set 23. Thereby, the original sheet P1 is held in the reverse path 22. At this time, as shown in FIG. 7C, the original sheet P1 having passed through the front-face and rear-face reading operations stays in the reverse path 22 in the front-face-up orientation and the original sheet P2 runs on the slit glass 9 in the rear-face-up orientation.

After that, the registration sensor 7 detects the trailing edge of the original sheet P2 which passes by the reading position. Upon this detection, the controller 50 activates the transfer clutch 58 to rotate the lower reverse roller 23*a*. The original sheet P1 held in the reverse path 22 is accordingly moved to the pull-out rollers 6.

During the above operation, the original sheet P2 is further advanced such that the leading edge thereof is detected by the sheet eject sensor 13. Upon this detection, the controller 50 activates the solenoid 54 to move the switch pawl 16 to the second position and forward drives the switchback motor 56 to rotate the FR drive roller 18 clockwise. Thereby, the original sheet P2 having passed through the front-face reading operation is transferred to the switchback path 20 through the second sheet path 17. At the same time, the controller 50 activates the transfer clutch 58 to rotate the lower reverse roller 23*a* so as to transfer the original sheet P1 to the first sheet path 31.

Figure 7D:
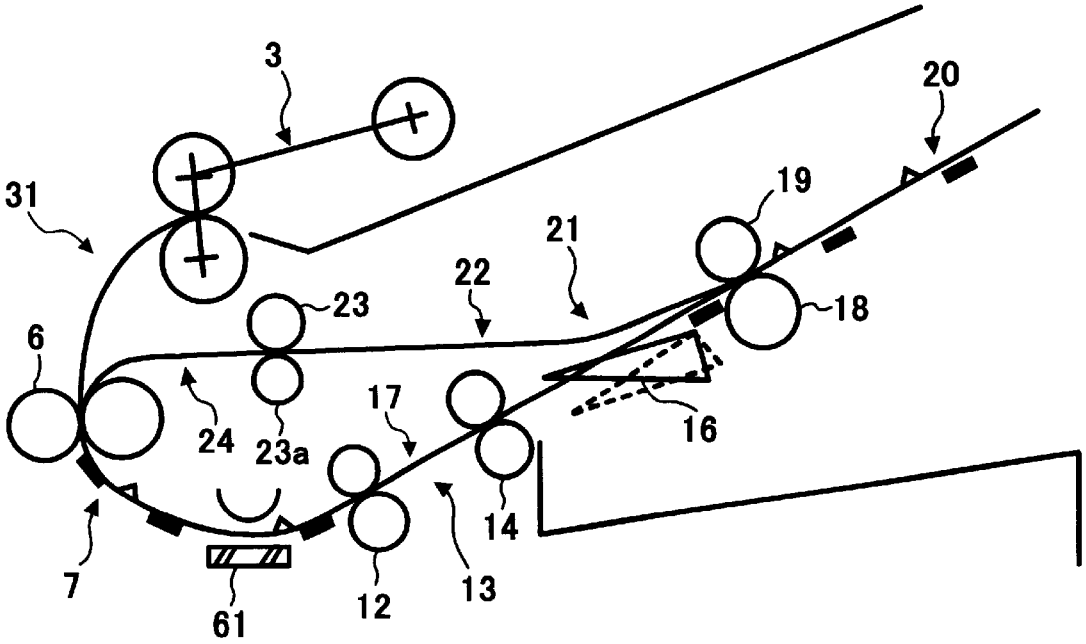

During the time when the original sheet P2 is moved into the switchback path 20, the trailing edge thereof is detected by the first reverse sensor 21. Then, the controller 50 deactivates the solenoid 54 to move the switch pawl 16 to the first position and reverse drives the switchback motor 56 to rotate the FR drive roller 18 counterclockwise. At this time, the original sheet P1 having passed through the front-face and rear-face reading operations runs through the first sheet path 31 and the original sheet P2 having passed through the front-face reading operation stays in the switchback path 20, as shown in FIG. 7D.

Figure 7E:
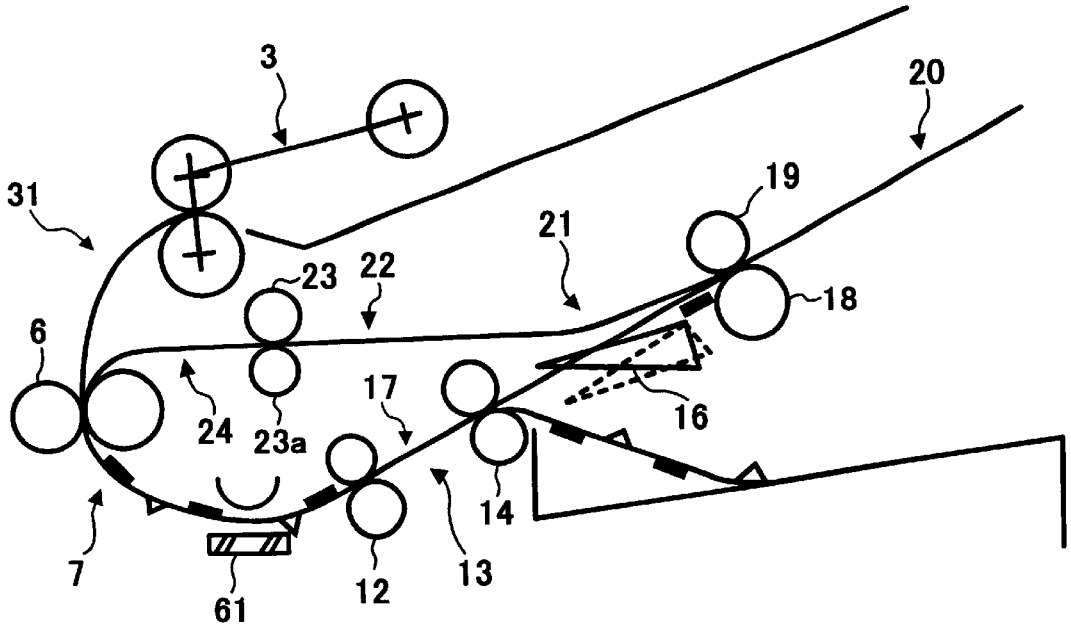

Then, the original sheet P1 is further transferred to the second sheet path 17 and is ejected therefrom to the sheet eject tray 15 via the switch pawl 16 which is switched at the second position. At the same time, the original sheet P2 is transferred again to the reading position on the slit glass 9 through the reverse path 22 via the reverse roller set 23 and the pull-out rollers 6 and, then, the reading operation relative to the rear-face of the original sheet P2 is started. At this time, the original sheet P1 having passed through the front-face and rear-face reading operations is ejected from the second sheet path 17 and is held in the sheet eject tray 15 in the rear-face-up orientation and the original sheet P2 passes through the rear, face reading operation, as shown in FIG. 7E.

Figure 7F:
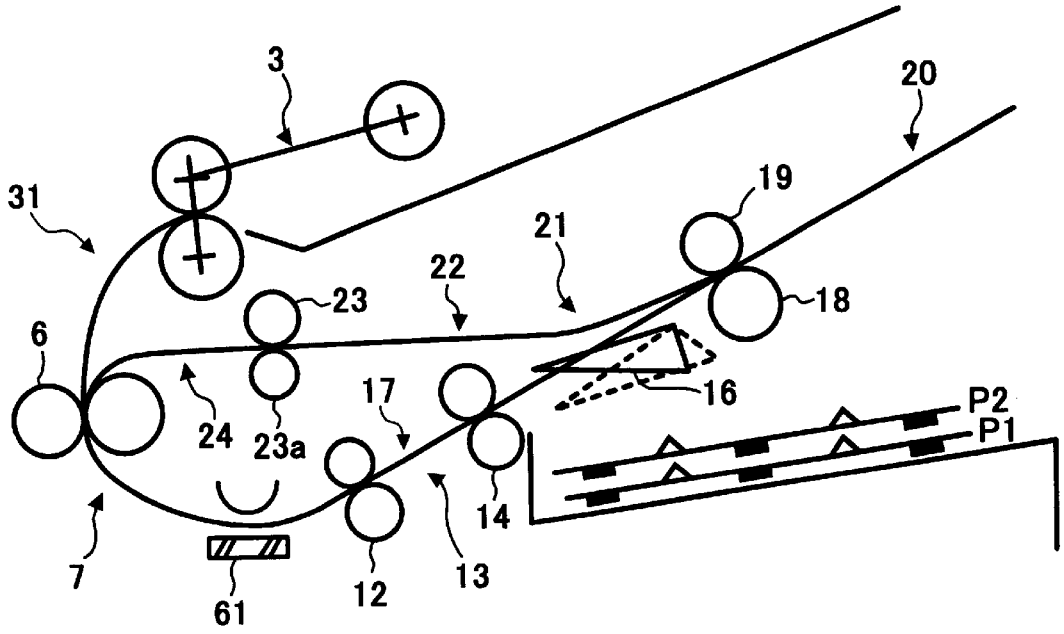

During the reading operation relative to the rear-face of the original sheet P2, the controller 50 activates the solenoid 54 to move the switch pawl 16 to the second position and forward drives the switchback motor 56 to rotate the FR drive roller 18 clockwise when the leading edge of the original sheet P2 is detected by the sheet eject sensor 13. Thereby, the original sheet P2 is transferred to the switchback path 20. When the first reverse sensor 21 detects the trailing edge of the original sheet P2, the controller 50 deactivates the solenoid 54 to move the switch pawl 16 to the first position and reverse drives the switchback motor 56 to rotate the FR drive roller 18 counterclockwise. Thereby, the original sheet P2 is transferred to the reverse path 22 and is then moved forward to the sheet eject tray 15 through the first and second sheet paths 31 and 17. Finally, the original sheet P2 is ejected from the second sheet path 17 and is held in the rear-face-up orientation on the original sheet P1 in the sheet eject tray 15, as shown in FIG. 7F.

In this way, the ADF 1 performs the sheet feeding operation at a relatively fast speed by inserting a succeeding sheet into the sheet path and starting the reading operation for that succeeding sheet during the time of performing the reading operation for a preceding sheet. In addition, the succeeding sheet is inserted into the sheet path with a sufficient distance from the trailing edge of the preceding sheet so that a paper jam between the sheets is avoided. Further, the reading operation relative to the rear-face of the preceding sheet can be completed when the succeeding sheet is inserted so that such reading operation does not suffer from a physical shock (i.e., vibration) caused by insertion of the succeeding sheet. Further, although the leading edge of the succeeding sheet comes into contact with the trailing edge of the preceding sheet in the switchback path when the sheets have a relatively large size, two sheets can be moved in opposite directions by providing the rollers with coefficients friction different from each other. Further, the ADF 1 does not need to include more than one eject path (i.e., the second sheet path) and more than one reverse path and, therefore, the ADF 1 can be structured in a relatively compact size. Further, the sheet eject tray is located under the switchback path in order to receive the sheets right after the reading operation so that the entire sheet path can be simplified.

Figure 8A:
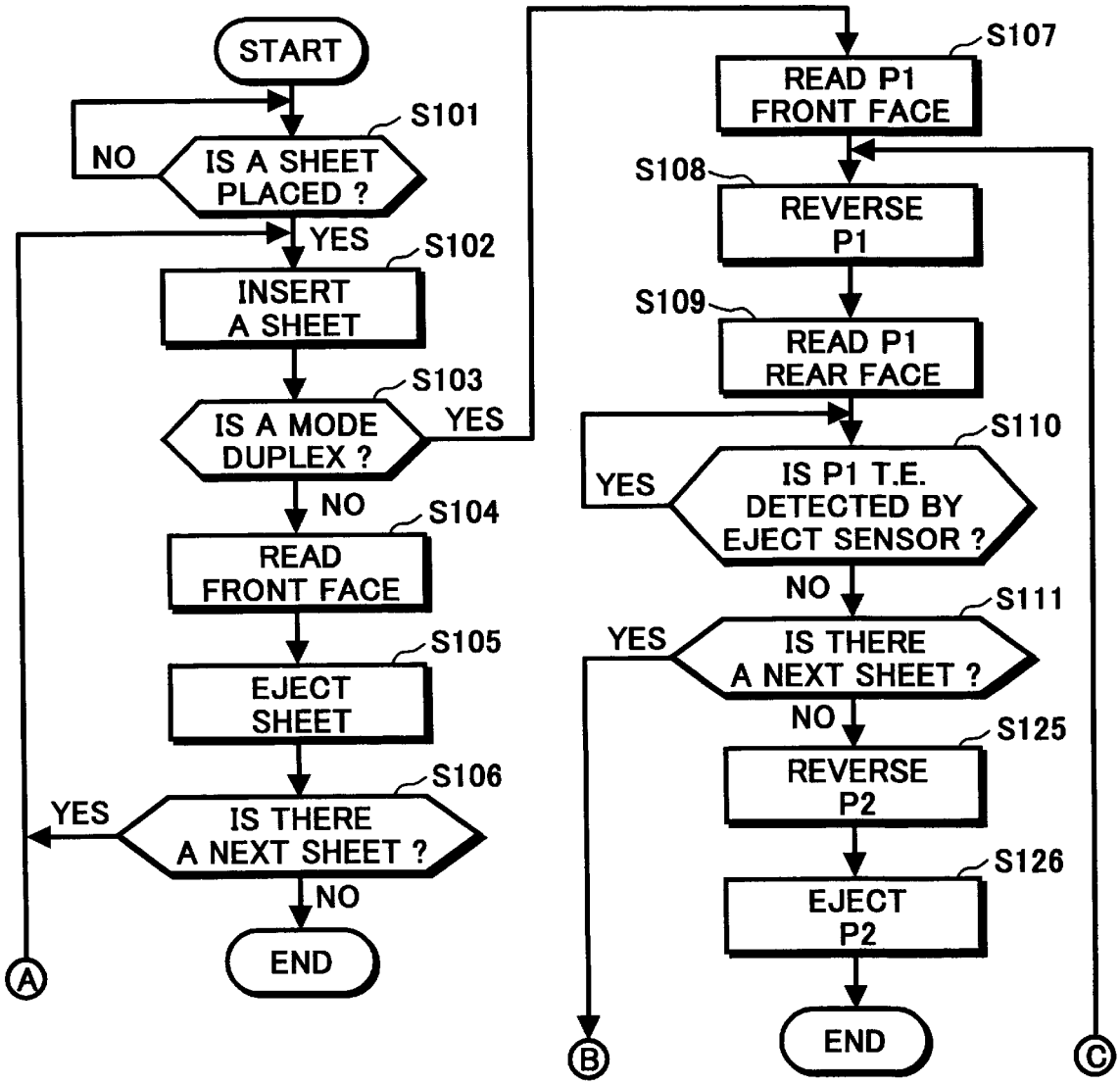
FIG. 8 is a flowchart for explaining details of a modified sheet feeding operation of the automatic sheet feed apparatus of FIG. 1.
Figure 8B:
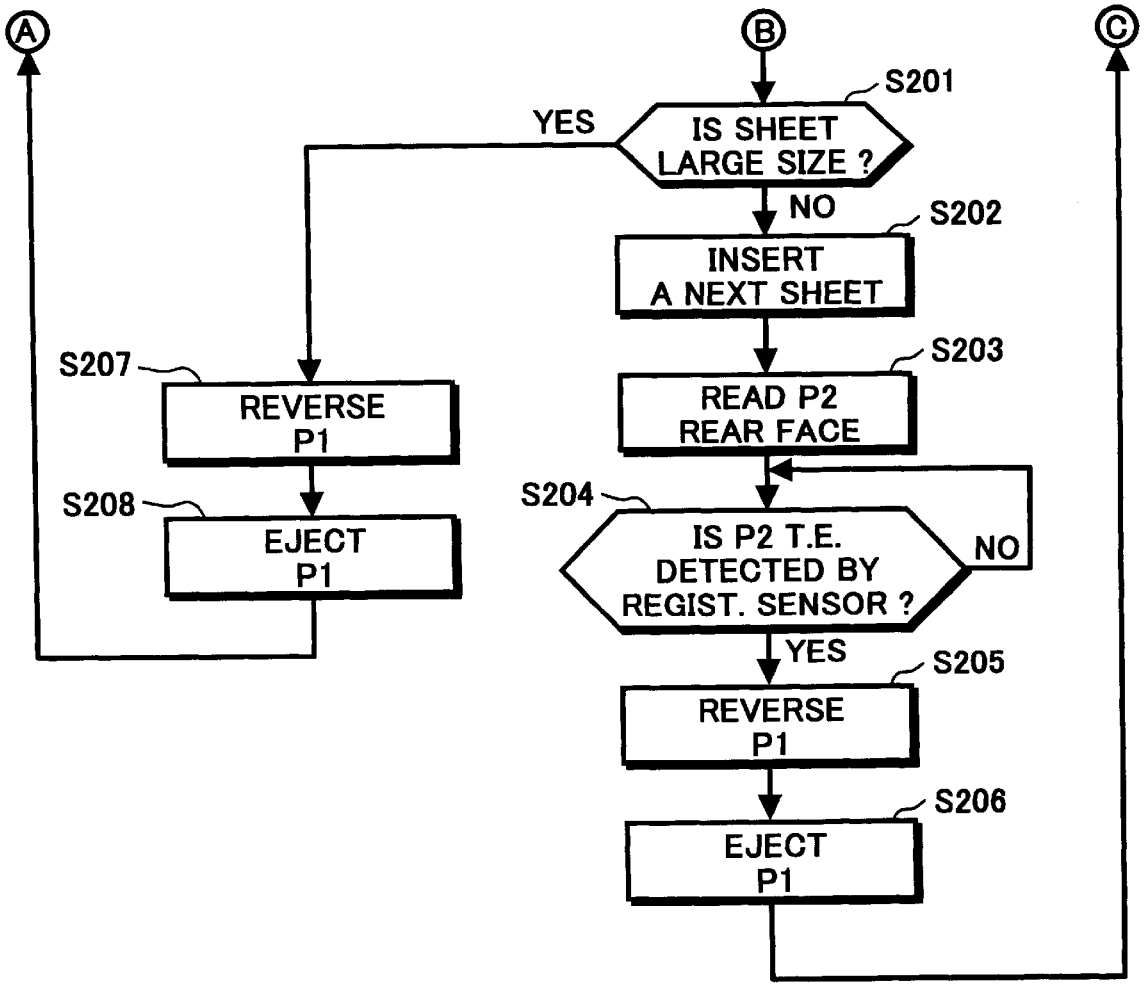

Next, an exemplary procedure of a modified sheet feeding operation of the ADF 1 is explained with reference to a flowchart of FIG. 8. The flowchart of FIG. 8 shows an exemplary procedure of a modified sheet feeding operation of the ADF 1. The flowchart of FIG. 8 is similar to that of FIG. 5, except for the timing control with respect to the insertion of the original sheet P2 and an elimination of the control of the FR driven roller 19 due to the reason explained below. The processes of Steps S201–S208 of FIG. 8 are modified specifically from those of Steps S112–S124 of FIG. 5. Therefore, the description below mainly describes the processes of Steps S201–S208.

In this example, when the original sheet set P is large-sized (e.g., an A3 sheet), the original sheet P2 is inserted into the sheet path when the trailing edge of the original sheet P1 is detected by the sheet eject sensor after the original sheet P1 has experienced both front-face and rear-face reading operations. The original sheet P1 is ejected from the second sheet path to the sheet eject tray before the reading operation relative to the front-face of the original sheet P2. In this case, it becomes unnecessary to move the FR driven roller 19 so as to make a gap between the FR drive and driven rollers 18 and 19 at a time when the leading edge of the original sheet P2 is moved into the switchback path 20 while the trailing edge of the long original sheet P1 remains in the switchback path 20.

On the other hand, in reading the small-sized original sheet, the solenoid 57 is not needed since the leading edge of the original sheet P2 does not meet the trailing edge of the original sheet P1 because the original sheet P1 can enter with its entire length in the reverse path 22 without remaining in the switchback path 20. Therefore, it is possible to obviate the solenoid 57 for moving the FR driven roller 19 in the ADF 1.

In the procedure of FIG. 15, the original sheet having passed through the rear-face reading operation is further transferred to the switchback path 20 and the sheet eject sensor 13 is turned off when the sheet eject sensor 13 detects the trailing edge of such original sheet P1. At this time, the check result of Step S110 is YES. Then, the process proceeds to Step S111 in which the controller 50 checks if there is the next sheet. If there is no further original sheet to be entered and the check result of Step S111 is NO, the process accordingly proceeds to Step S125 in which the switchback operation is performed to move the original sheet P1 to the reverse path 22 in the rear-face-up orientation through the reverse path 22 and the first sheet path 31. In Step S126, the original sheet P1 is ejected to the sheet eject tray 15. The process then ends.

If there is a next sheet and the check result of Step S111 is YES, the process proceeds to Step S201. In Step S201, the controller 50 checks if the original sheet P has a relatively large size (e.g., an A3 size) or a relatively smaller size (e.g., an A4 size). In a case of the large-sized sheet, the original sheet P1 is moved into the reverse path 22 through the switchback operation in Step S207. Then, the original sheet P1 is ejected to the sheet eject tray 15 in Step S208. After that, the process proceeds to Step S102 in which the succeeding original sheet P2 is inserted into the first sheet path 31. Then, the original sheet P2 is processed for both front-face and rear-face reading operations through the same processes of Steps S103 and S107–S111 and is ejected through the processes of Steps S125 and S126. Then, the process ends.

Figure 9:
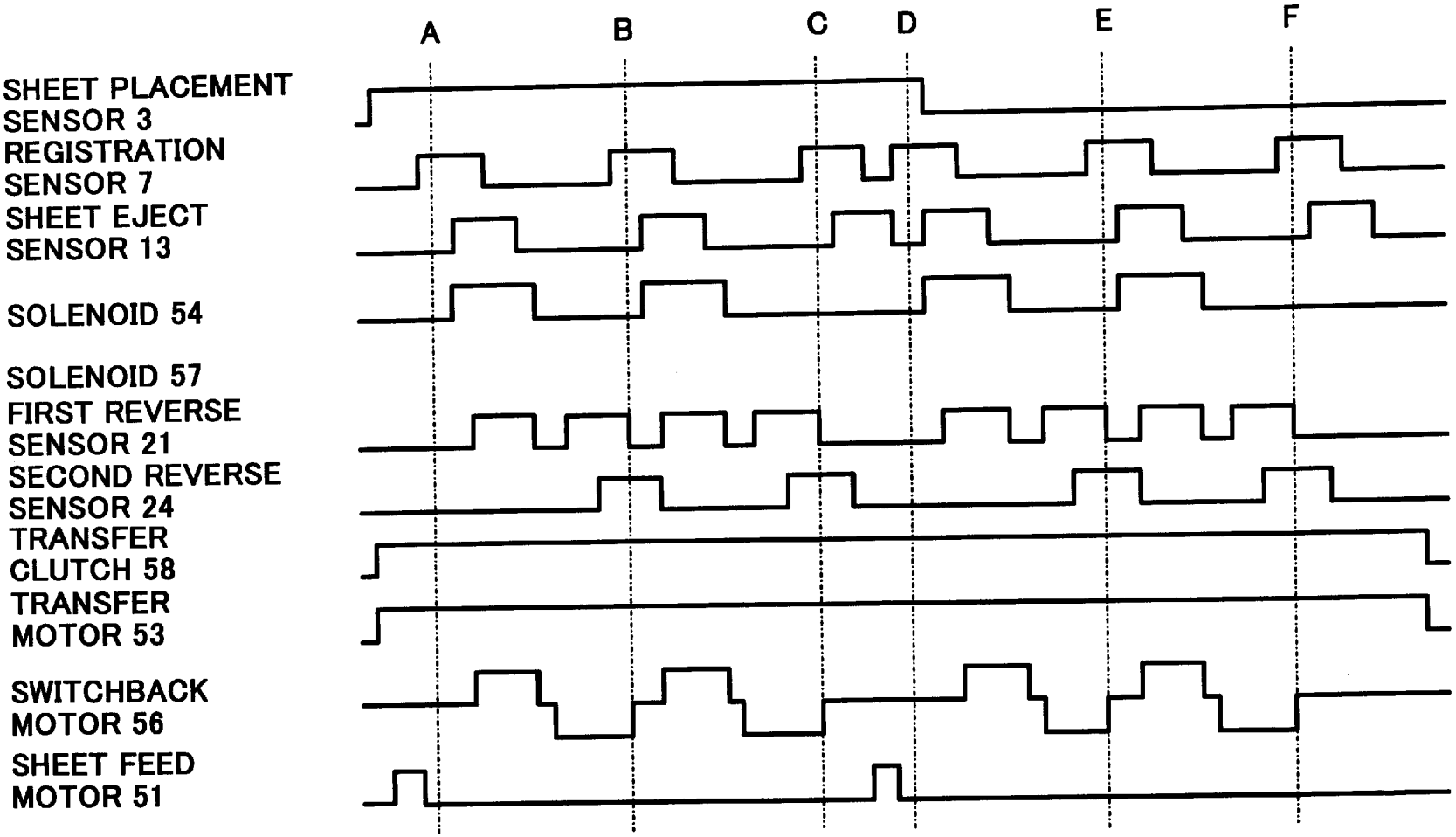
FIG. 9 is a timing chart explaining the modified sheet feeding operation of FIG. 8.

In this way, the ADF 1 performs the modified sheet feeding operation relative to the large-sized original sheet. FIG. 9 is a timing chart illustrating this case.

If the original sheet P1 has a relatively small size (e.g., an A4 size) and the check result of Step S201 is NO, the process proceeds to Step S202 in which the next original sheet P2 is inserted into the first sheet path 31. At this time, the original sheet P1 is temporarily held in the switchback path 20. In Step S203, the original sheet P2 is fed to the reading position at which the front-face of the original sheet P2 is then read by the image reading mechanism 62 of the copying apparatus 60.

In Step S204, the controller 50 checks if the registration sensor 7 detects the trailing edge of the original sheet P2 during the front-face reading operation. If the registration sensor 7 detects the trailing edge of the original sheet P2 and the check result of Step S204 is YES, the process proceeds to Step S205 in which the switchback operation is performed to move the original sheet P1 held in the switchback path 20 to the reverse path 22. In Step S206, the sheet eject operation is performed to eject the original sheet P1 to the sheet eject tray 15.

Then, the process proceeds to Step S108 and the controller 50 performs the operation through Steps S108 to S111 and Steps S125 and S126 in a manner similar to the operation performed for the large-sized original sheet set P as described above. In this way, the ADF 1 performs the modified sheet feeding operation for the small-sized original sheet (e.g., an A4, sized sheet) is performed.

The mechanisms and processes set forth in the present description may be implemented using a conventional general purpose microprocessor (e.g., FIG. 2, controller 50) programuned according to the teachings in the present specification (e.g., as shown in FIGS. 3–5, 8 and 9), as will be appreciated to those skilled in the relevant art(s). Appropriate software coding can readily be prepared by skilled programuners based on the teachings of the present disclosure, as will also be apparent to those skilled in the relevant art(s).

The present invention thus also includes a computer-based product which may be hosted on a storage medium and include instructions which can be used to program a microprocessor (e.g., FIG. 2, controller 50) to perform processes in accordance with the present invention (e.g., as shown in FIGS. 3–5, 8 and 9). This storage medium can include, but is not limited to, any type of disk including floppy disks, optical disks, CD-ROMs, magneto-optical disks, ROMs, RAMs, EPROMs, EEPROMs, flash memory, magnetic or optical cards, or any type of media suitable for storing electronic instructions.

Obviously, numerous additional modifications and variations of the present invention are possible in light of the above teachings. It is therefore to be understood that within the scope of the appended claims, the present invention may be practiced otherwise than as specifically described herein.

This document claims priority and contains subject matter related to Japanese Patent Application No. JPAP10-258922 filed in the Japanese Patent Office on Sep. 11, 1998, the entire contents of which are hereby incorporated by reference.

What is claimed as new and desired to be secured by Letters Patent of the United States is:

1. A sheet feed apparatus, comprising:

a sheet table for holding a sheet set including at least one sheet;

a single sheet transfer mechanism, which includes a single sheet flipping mechanism, for sequentially performing in order a first transfer operation in which an initial sheet is separated from said sheet set placed on said sheet table and said initial sheet is transferred via a first connecting path to a reading position to receive a front-face sheet reading operation, and a second transfer operation in which the single sheet flipping mechanism flips over the initial sheet and transfers said initial sheet via said first connecting path to the reading position to receive a rear-face sheet reading operation; and a controller for controlling said single sheet transfer mechanism to perform said first transfer operation on a succeeding sheet after said initial sheet passes by said reading position during said second transfer operation on said initial sheet, for controlling the single sheet sheet flipping mechanism to again flip over the initial sheet, and for controlling the single sheet transfer mechanism to eject the initial sheet only after the first transfer operation has been performed on the succeeding sheet and the first and second transfer operations have been performed on the initial sheet.

2. The sheet feed apparatus as defined in claim 1, wherein said single sheet transfer mechanism comprises:

a first path member for providing a switchback path, said first path member positioned under said sheet table and connected to said reading position via a second connecting path, said first path member receiving said initial sheet after one of said front-face and rear-face sheet reading operations, said second connecting path including a sheet eject portion for ejecting said initial sheet under control of said controller;

a switchback member, mounted on said first path member, for forwarding, holding, and reversing said initial sheet under control of said controller; and a second path member for providing a reverse path which said initial sheet passes through and is held in under control of said controller, wherein said second path member is positioned under said sheet table and connected to said first path member at one end thereof to receive said initial sheet moved in a reversed direction from said first path member and connected to said first connecting path at the other end thereof to transfer said initial sheet to said reading position.

3. The sheet feed apparatus as defined in claim 2, wherein said single sheet transfer mechanism further comprises a first detecting mechanism, mounted before said sheet eject portion on said second connecting path, for detecting a trailing edge of said initial sheet, and said controller controls said single sheet transfer mechanism to perform said first transfer operation on a succeeding sheet when said first detecting mechanism detects said trailing edge of said initial sheet during one of:

said second transfer operation when said initial sheet has a shorter length than said predetermined value in a direction parallel to said transfer direction, and said third transfer operation when said initial sheet has a longer length than said predetermined value in a direction parallel to said transfer direction.

4. The sheet feed apparatus as defined in claim 2, further comprising a sheet eject tray, mounted under said first path member, for receiving said initial sheet ejected from said sheet eject portion of said second connecting path included in said transfer mechanism.

5. The sheet feed apparatus as defined in claim 4, wherein said single sheet transfer mechanism further comprises a sheet flow switch mechanism, mounted at a position downstream of said second connecting path, for switching under control of said controller between a first sheet flow in which said initial sheet is transferred through said second connecting path to said sheet eject tray, a second sheet flow in which said initial sheet is transferred through said second connecting path to said first path member, and a third sheet flow in which said initial sheet is transferred from said first path member to said second path member.

6. The sheet feed apparatus as defined in claim 2, wherein said switchback member includes a drive roller rotatable in forward and reverse directions and a driven roller.

7. The sheet feed apparatus as defined in claim 6, wherein said drive roller is mounted under said driven roller on said first path member.

8. The sheet feed apparatus as defined in claim 2, wherein said single sheet transfer mechanism further comprises a switchback member moving mechanism, mounted on said first path member, for moving said switchback member to free said initial sheet in said first path member, said controller controls said single sheet transfer mechanism to perform said first transfer operation on a succeeding sheet before said third transfer operation is performed on said initial sheet when said initial sheet has a longer length than a predetermined value in a direction parallel to said transfer direction, and said controller controls said switchback member moving mechanism to move said switchback member to free said initial sheet during said third transfer operation so that said succeeding sheet of said first transfer operation is allowed to enter into said first path member in contact with said initial sheet and then controls said switchback member moving mechanism to return said switchback member so as to reverse said initial sheet and to send forward said succeeding sheet simultaneously.

9. The sheet feed apparatus as defined in claim 8, wherein said switchback member includes a drive roller rotatable in forward and reverse directions and a driven roller movable by said switchback member moving mechanism.

10. The sheet feed apparatus as defined in claim 8, wherein said single sheet transfer mechanism further comprises a second detecting mechanism, mounted before said sheet eject portion on said second connecting path, for detecting a trailing edge of said initial sheet, and said controller controls said single sheet transfer mechanism to perform said first transfer operation on a succeeding sheet when said second detecting mechanism detects said trailing edge of said initial sheet during said second transfer operation when said initial sheet has a longer length than said predetermined value in a direction parallel to said transfer direction.

11. The sheet feed apparatus as defined in claim 10, wherein said single sheet transfer mechanism further comprises:

a sheet feed mechanism, mounted upstream of said first connecting path, for separating said initial sheet from said sheet set placed on said sheet table and transfers to said reading position during said first sheet transfer operation; and a third detecting mechanism, mounted downstream from said sheet feed mechanism and upstream from a point at which said second path member is connected to said first connecting path, for detecting a sheet separated from said initial sheet set, wherein said controller controls said sheet feed mechanism to perform said first sheet transfer operation after said initial sheet passes by said reading position and to stop said first sheet transfer operation when said third detecting mechanism detects said succeeding sheet.

12. A sheet feed apparatus, comprising:

a sheet holding means for holding which includes a sheet set including at least one sheet;

a single sheet transfer means, which includes a single sheet flipping means, for sequentially performing in order a first transfer operation in which an initial sheet is separated from said sheet set placed on said sheet holding means and said initial sheet is transferred via a first connecting path to a reading position to receive a front-face sheet reading operation, and a second transfer operation i n which the single sheet flipping means flips over the initial sheet and transfers said initial sheet via said first connecting path to the reading position to receive a rear-face sheet reading operation; and a controlling means for controlling said single sheet transfer means to perform said first transfer operation on a succeeding sheet after said initial sheet passes by said reading position during said second transfer operation on said initial sheet, for controlling the single sheet flipping means to again flip over the initial sheet, and for controlling the single sheet transfer means to eject the initial sheet only after the first transfer operation has been performed on the succeeding sheet and the first and second transfer operations have been performed on the initial sheet.

13. The sheet feed apparatus as defined in claim 12, wherein said single sheet transfer means comprises:

a first path means for providing a switchback path, said first path means positioned under said sheet holding means and connected to said reading position via a second connecting path, said first path means receiving said initial sheet after one of said front-face and rear-face sheet reading operations, said second connecting path including a sheet eject means for ejecting said initial sheet under control of said controlling means;

a switchback means, mounted on said first path means, for forwarding, holding, and reversing said initial sheet under control of said controlling means; and a second path means for providing a reverse path which said initial sheet passes through and is held in under control of said controlling means, wherein said second path means is positioned under said sheet holding means and connected to said first path means at one end thereof to receive said initial sheet moved in a reversed direction from said first path means and connected to said first connecting path at the other end thereof to transfer said initial sheet to said reading position.

14. The sheet feed apparatus as defined in claim 13, wherein said single sheet transfer means further comprises a first detecting means, mounted before said sheet eject means on said second connecting path, for detecting a trailing edge of said initial sheet, and said controlling means controls said single sheet transfer means to perform said first transfer operation on a succeeding sheet when said first detecting means detects said trailing edge of said initial sheet during one of:

said second transfer operation when said initial sheet has a shorter length than said predetermined value in a direction parallel to said transfer direction, and said third transfer operation when said initial sheet has a longer length than said predetermined value in a direction parallel to said transfer direction.

15. The sheet feed apparatus as defined in claim 13, wherein said switchback means includes a drive roller rotatable in forward and reverse directions and a driven roller.

16. The sheet feed apparatus as defined in claim 15, wherein said drive roller means is mounted under said driven roller means on said first path means.

17. The sheet feed apparatus as defined in claim 13, further comprising a sheet tray means, mounted under said first path means, for receiving said initial sheet ejected from said sheet eject means of said second connecting path included in said transfer means.

18. The sheet feed apparatus as defined in claim 17, wherein said single sheet transfer means further comprises a sheet flow switch means, mounted at a position downstream of said second connecting path, for switching under control of said controlling means between a first sheet flow in which said initial sheet is transferred through said second connecting path to said sheet tray means, a second sheet flow in which said initial sheet is transferred through said second connecting path to said first path means, and a third sheet flow in which said initial sheet is transferred from said first path means to said second path means.

19. The sheet feed apparatus as defined in claim 13, wherein said single sheet transfer means further comprises a switchback moving means, mounted on said first path means, for moving said switchback means to free said initial sheet in said first path means, said controlling means controls said single sheet transfer means to perform said first transfer operation on a succeeding sheet before said third transfer operation is performed on said initial sheet when said initial sheet has a longer length than a predetermined value in a direction parallel to said transfer direction, and said controlling means controls said switchback moving means to move said switchback means to free said initial sheet during said third transfer operation so that said succeeding sheet of said first transfer operation is allowed to enter into said first path means in contact with said initial sheet and then controls said switchback moving means to return said switchback means so as to reverse said initial sheet and to send forward said succeeding sheet simultaneously.

20. The sheet feed apparatus as defined in claim 19, wherein said switchback means includes a drive roller means rotatable in forward and reverse directions and a driven roller means movable by said switchback moving means.

21. The sheet feed apparatus as defined in claim 19, wherein said single sheet transfer means further comprises a second detecting means, mounted before said sheet eject means on said second connecting path, for detecting a trailing edge of said initial sheet, and said controlling means controls said single sheet transfer means to perform said first transfer operation on a succeeding sheet when said second detecting means detects said trailing edge of said initial sheet during said second transfer operation when said initial sheet has a longer length than said predetermined value in a direction parallel to said transfer direction.

22. The sheet feed apparatus as defined in claim 21, wherein said single sheet transfer means further comprises:

a sheet feed means, mounted upstream of said first connecting path, for separating said initial sheet from said sheet set placed on said sheet holding means and transfers to said reading position during said first sheet transfer operation; and a third detecting means, mounted downstream from said sheet feed means and upstream from a point at which said second path means is connected to said first connecting path, for detecting a sheet separated from said sheet set, wherein said controlling means controls said sheet feed means to perform said first sheet transfer operation after said initial sheet passes by said reading position and to stop said first sheet transfer operation when said third detecting means detects said succeeding sheet.

23. A sheet feed method, comprising:

holding a sheet set including at least one sheet;

sequentially performing in order via a single sheet transfer mechanism, which includes a single sheet flipping mechanism, a first transfer operation in which an initial sheet is separated from said sheet set and said initial sheet is transferred to a reading position to receive a front-face sheet reading operation, and a second transfer operation in which the single sheet flipping mechanism flips over the initial sheet and transfers said initial sheet to the reading position to receive a rear-face sheet reading operation;

controlling said single sheet transfer mechanism to perform said first transfer operation on a succeeding sheet after said initial sheet passes by said reading position during said second transfer operation on said initial sheet;

controlling the single sheet flipping mechanism to again flip over the initial sheet; and controlling the single sheet transfer mechanism to eject the initial sheet only after the first transfer operation has been performed on the succeeding sheet and the first and second transfer operations have been performed on the initial sheet.

24. The sheet feed method as defined in claim 23, wherein said sequentially performing step comprises:

providing a switchback path to receive said initial sheet after one of said front-face and rear-face sheet reading operations;

ejecting said initial sheet;

forwarding, holding, and reversing said initial sheet; and providing a reverse path which said initial sheet passes through and is held in.

25. The sheet feed method as defined in claim 24, further comprising:

detecting a trailing edge of said initial sheet; and performing said first transfer operation on a succeeding sheet when said trailing edge of said initial sheet is detected during one of:

said second transfer operation when said initial sheet has a shorter length than said predetermined value in a direction parallel to said transfer direction, and said third transfer operation when said initial sheet has a longer length than said predetermined value in a direction parallel to said transfer direction.

26. The sheet feed method as defined in claim 24, further comprising receiving said ejected initial sheet.

27. The sheet feed method as defined in claim 26, further comprising switching between a first sheet flow in which said initial sheet is transferred through a second connecting path, a second sheet flow in which said initial sheet is transferred through a second connecting path to a first path, and a third sheet flow in which said initial sheet is transferred from said first path to a second path.

28. The sheet feed method as defined in claim 24, further comprising providing a drive roller means rotatable in forward and reverse directions and a driven roller means.

29. The sheet feed method as defined in claim 28, further comprising providing mounting said drive roller means under said driven roller means.

30. The sheet feed method as defined in claim 24, further comprising:

performing said first transfer operation on a succeeding sheet before said third transfer operation is performed on said initial sheet when said initial sheet has a longer length than a predetermined value in a direction parallel to said transfer direction;

freeing said initial sheet during said third transfer operation so that said succeeding sheet of said first transfer operation is in contact with said initial sheet; and reversing said initial sheet and sending forward said succeeding sheet simultaneously.

31. The sheet feed method as defined in claim 30, further comprising providing a drive roller means rotatable in forward and reverse directions and a driven roller means movable by said switchback member moving means.

32. The sheet feed method as defined in claim 30, further comprising:

detecting a trailing edge of said initial sheet; and performing said first transfer operation on a succeeding sheet when said trailing edge of said initial sheet is detected during said second transfer operation when said initial sheet has a longer length than said predetermined value in a direction parallel to said transfer direction.

33. The sheet feed method as defined in claim 31, further comprising:

separating said initial sheet from said sheet set and transferring said initial sheet to said reading position during said first sheet transfer operation;

detecting a sheet separated from said sheet set; and performing said first sheet transfer operation after said initial sheet passes by said reading position and to stop said first sheet transfer operation when said succeeding a sheet is detected.

34. A computer readable medium storing computer instructions for performing the steps recited in anyone of claims 23–33.

* * * * *